US008061766B2

(12) United States Patent
Miller

(10) Patent No.: US 8,061,766 B2
(45) Date of Patent: Nov. 22, 2011

(54) FOLDABLE CHAIR

(76) Inventor: Greg Miller, St. Charles, MO (US)

( * ) Notice: Subject to any disclaimer, the term of this patent is extended or adjusted under 35 U.S.C. 154(b) by 273 days.

(21) Appl. No.: 12/511,430

(22) Filed: Jul. 29, 2009

(65) Prior Publication Data

US 2010/0026057 A1 Feb. 4, 2010

Related U.S. Application Data

(60) Provisional application No. 61/084,415, filed on Jul. 29, 2008.

(51) Int. Cl.
*A47C 4/44* (2006.01)

(52) U.S. Cl. ..... 297/60; 297/41; 297/59

(58) Field of Classification Search ..... 297/16.1, 297/35, 41, 59, 60
See application file for complete search history.

(56) References Cited

U.S. PATENT DOCUMENTS

| | | | | | |
|---|---|---|---|---|---|
| 534,501 | A | | 2/1895 | Evers | |
| 1,694,933 | A | | 12/1928 | Walker et al. | |
| 1,730,895 | A | * | 10/1929 | Ness | 297/41 |
| 1,869,365 | A | * | 8/1932 | Corduan | 297/60 |
| 1,876,479 | A | | 9/1932 | Weller | |
| 1,916,772 | A | * | 7/1933 | Pratt | 297/41 |
| 1,963,708 | A | | 6/1934 | Marvin | |
| 2,110,519 | A | * | 3/1938 | Croft | 297/60 |
| 2,450,783 | A | | 10/1948 | Collins | |
| 2,505,702 | A | | 4/1950 | Benjamin | |
| 2,699,557 | A | * | 1/1955 | Gravatt | 5/626 |
| 2,732,006 | A | | 1/1956 | Crescent | |
| 2,809,047 | A | * | 10/1957 | Strohmaier | 297/51 |
| 4,030,781 | A | | 6/1977 | Howard | |
| 4,251,107 | A | | 2/1981 | Sato | |
| 4,367,894 | A | | 1/1983 | Manuel | |
| 5,078,451 | A | | 1/1992 | Sobel | |
| 5,087,095 | A | | 2/1992 | McFate | |
| 5,110,184 | A | | 5/1992 | Stein | |
| 5,244,249 | A | | 9/1993 | Tseng | |
| D361,683 | S | | 8/1995 | Juhl | |
| 5,464,268 | A | | 11/1995 | Levrangi | |
| 5,503,456 | A | | 4/1996 | Rossini | |
| 5,584,529 | A | * | 12/1996 | Cheng | 297/38 |
| 5,588,695 | A | | 12/1996 | Gomes | |
| 5,588,696 | A | | 12/1996 | Jay et al. | |
| 5,718,473 | A | | 2/1998 | Lynch, Jr. | |
| 5,944,384 | A | | 8/1999 | Patterson | |
| 5,988,750 | A | | 11/1999 | Rubottom | |
| 6,056,172 | A | | 5/2000 | Welsh | |
| 6,056,353 | A | * | 5/2000 | Meara | 297/41 |
| 6,089,651 | A | | 7/2000 | Carmen | |
| 6,382,727 | B1 | | 5/2002 | Pickard | |

(Continued)

FOREIGN PATENT DOCUMENTS

| | | |
|---|---|---|
| EP | 0569317 | 11/1993 |

(Continued)

*Primary Examiner* — Peter R. Brown
(74) *Attorney, Agent, or Firm* — Polster, Lieder, Woodruff & Lucchesi, L.C.

(57) ABSTRACT

A chair. The chair folds by a plurality of hinges between an expanded position and a collapsed position to seat a person substantially horizontal while the chair is positioned on an angled surface. The chair comprises a back assembly, a seat assembly, a leg assembly, a seat, an arm assembly. The chair further comprises at least one anchor that is configured to penetrate the angled surface in order to stabilize the chair on the angled surface.

12 Claims, 30 Drawing Sheets

U.S. PATENT DOCUMENTS

| | | | | |
|---|---|---|---|---|
| 6,471,288 | B2 | 10/2002 | Alexander, Jr. | |
| 6,547,324 | B1 | 4/2003 | Ammann, Jr. | |
| 6,736,450 | B2 * | 5/2004 | Miyagi | 297/16.2 |
| 6,796,605 | B1 | 9/2004 | Chu | |
| 6,926,355 | B2 | 8/2005 | Le Gette | |
| 7,147,277 | B1 | 12/2006 | Miller | |
| 2002/0145316 | A1 | 10/2002 | Oliver | |
| 2004/0130190 | A1 | 7/2004 | Zheng | |
| 2004/0195879 | A1 | 10/2004 | Amirault | |

FOREIGN PATENT DOCUMENTS

| | | |
|---|---|---|
| EP | WO02/069757 | 9/2002 |
| JP | 2000135144 | 5/2000 |

* cited by examiner

FOLDABLE CHAIR

CROSS-REFERENCE TO RELATED APPLICATIONS

This application claims priority under 35 U.S.C. §119(e) to U.S. Provisional Patent Application No. 61/084,415 filed Jul. 29, 2008, in the name of the present inventor and entitled "Foldable Chair" and is incorporated herein by reference.

STATEMENT REGARDING FEDERALLY SPONSORED RESEARCH

Not Applicable.

BACKGROUND OF THE DISCLOSURE

The present disclosure relates to a folding chair, and in particular, a folding chair that anchors to an angled surface while providing a horizontal seat position for the user.

Many parks, common areas and outdoor entertainment venues have ground seating areas that cover hills or inclines. Typically these seating areas do not employ any fixed seats or chairs. Instead, the user sits directly on the seating areas. To eliminate direct contact between the ground of the seating area and the user's bottom, the user typically positions a blanket or folding chair on the ground for sitting purposes. The blanket and folding chair, however, lie on the seating area at the same angle of the ground of the seating area. Therefore, due to the angled ground surface, the user sits at the angle resulting in uncomfortable viewing by the user.

Although current folding chairs have adjustable back rests and adjustable arm rests, the legs of these chairs extend to contact the ground, wherein this configuration positions the seat of the chair at the angle of the ground sitting area. As such, the adjustable back rest and adjustable arm rest do not horizontally position the user with respect to the angled ground.

Other folding chairs employ collapsible fabric as the seat area. This collapsible fabric conforms to the user's bottom when the user sits within the fabric. Due to the leg configurations of these chairs, the user still sits at the angle of the ground sitting area. Furthermore, due to the angled ground, current folding chairs slip on the angled surface since the legs do not anchor to the ground surface.

BRIEF SUMMARY OF THE DISCLOSURE

Briefly stated, the present disclosure relates to a chair that folds by a plurality of hinges between an expanded position and a collapsed position to seat a person upon a seat substantially horizontal while the chair is positioned on an angled surface.

The foldable chair comprises a back assembly having a back frame and a back covering which partially covers the back frame. The chair also comprises a support assembly secured to a support hinge of the plurality of hinges. The chair also comprises an arm assembly operatively connected to the support assembly and operatively connected to the back assembly. The arm assembly further includes a hanger that rotatably connects with the seat of the chair. The seat operatively connects to the arm assembly via the rotating hanger such that the rotating hanger positions the body of the seat in a substantially horizontal position with respect to the angled surface.

The foregoing features and advantages of the disclosure as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure.

The present invention relates to outdoor, foldable furniture. The furniture can be used in any appropriate foldable situation. For purposes of illustration only, the furniture will be described as incorporated into a chair. Applicant's U.S. Pat. No. 7,147,277 is incorporated herein by reference.

Figure 3:
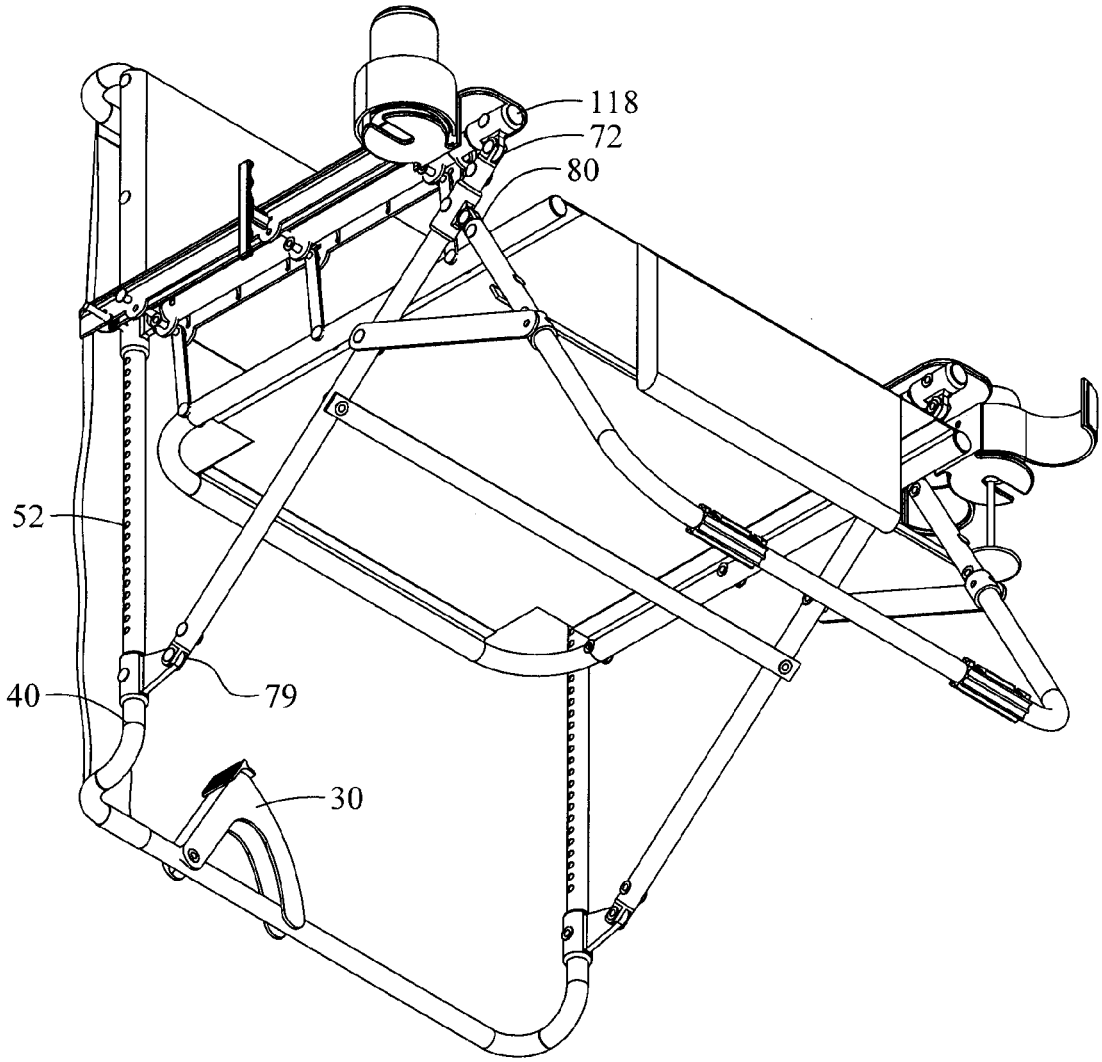
FIG. 3 is a left bottom perspective view of the chair.
Figure 4:
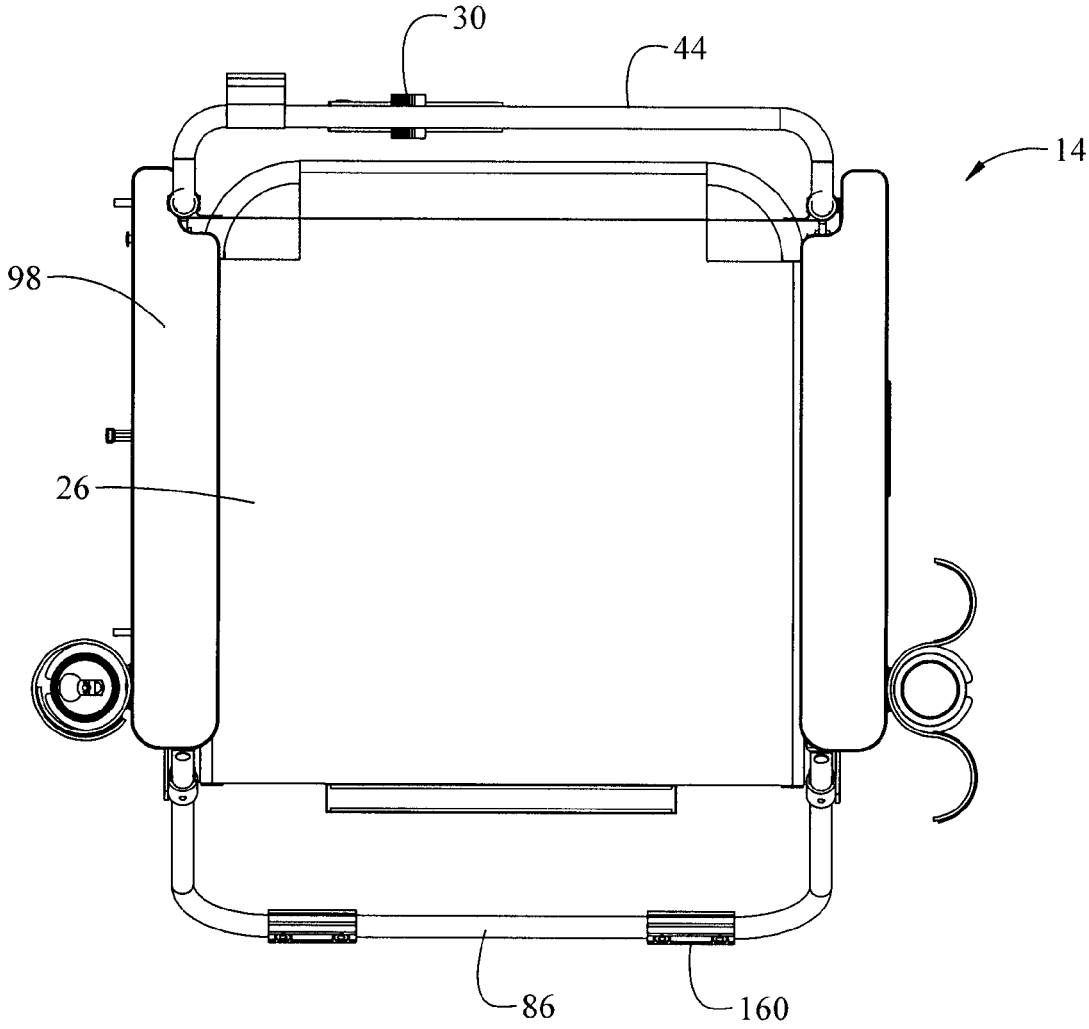
FIG. 4 is a top view of the chair of the present disclosure.
Figure 5:
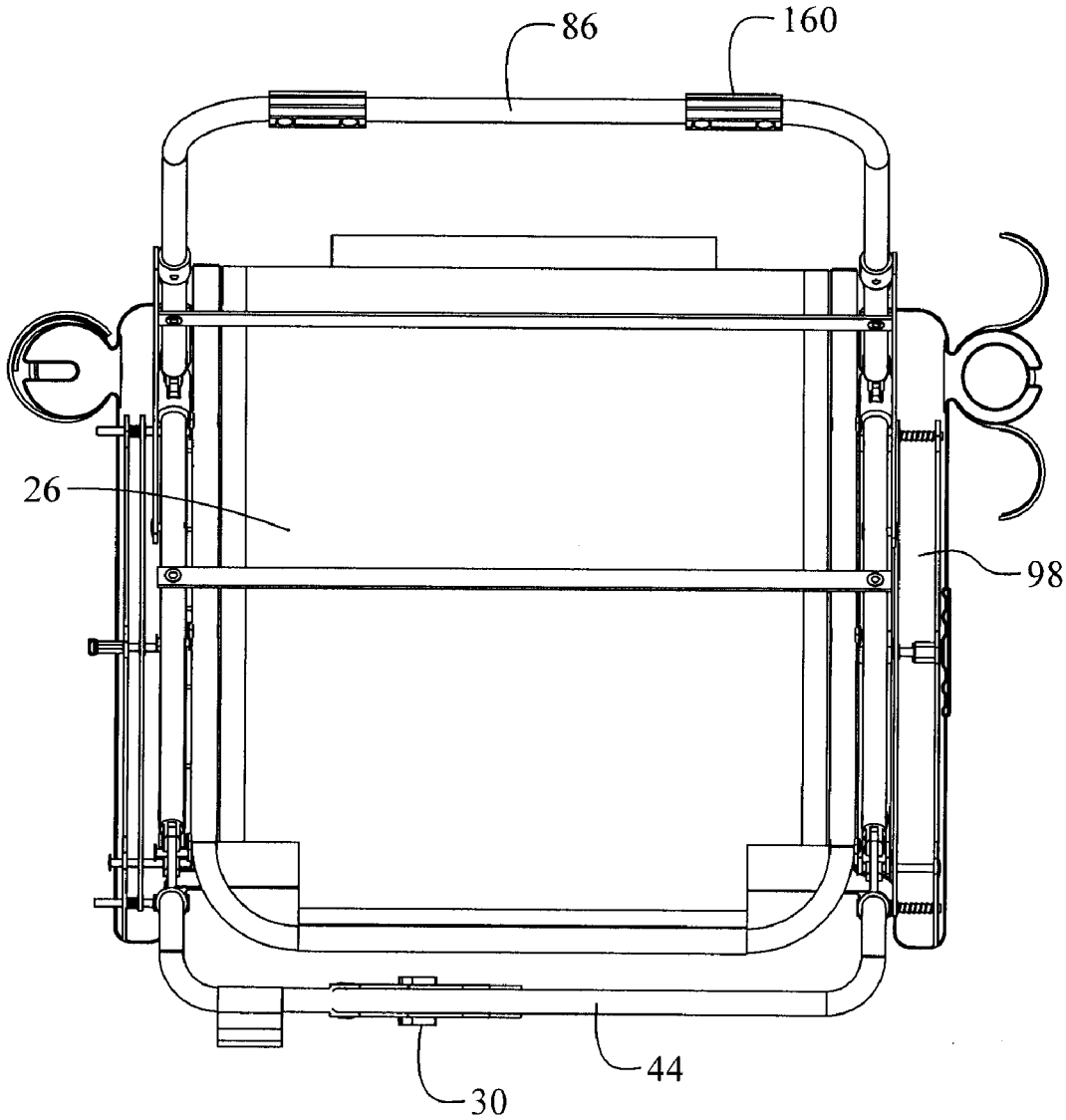
FIG. 5 is a bottom view thereof.
Figure 6:
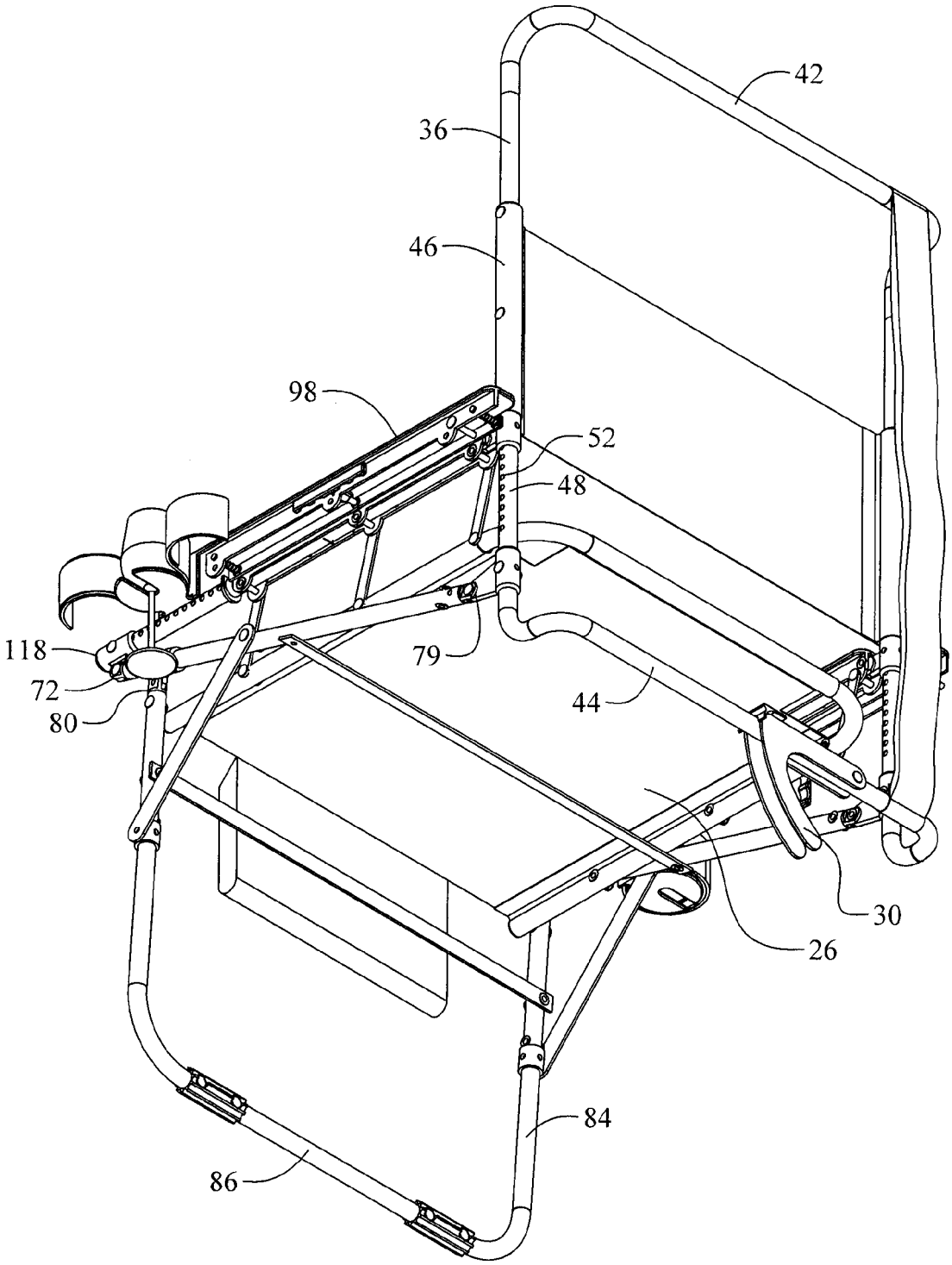
FIG. 6 is a bottom perspective view.
Figure 21:
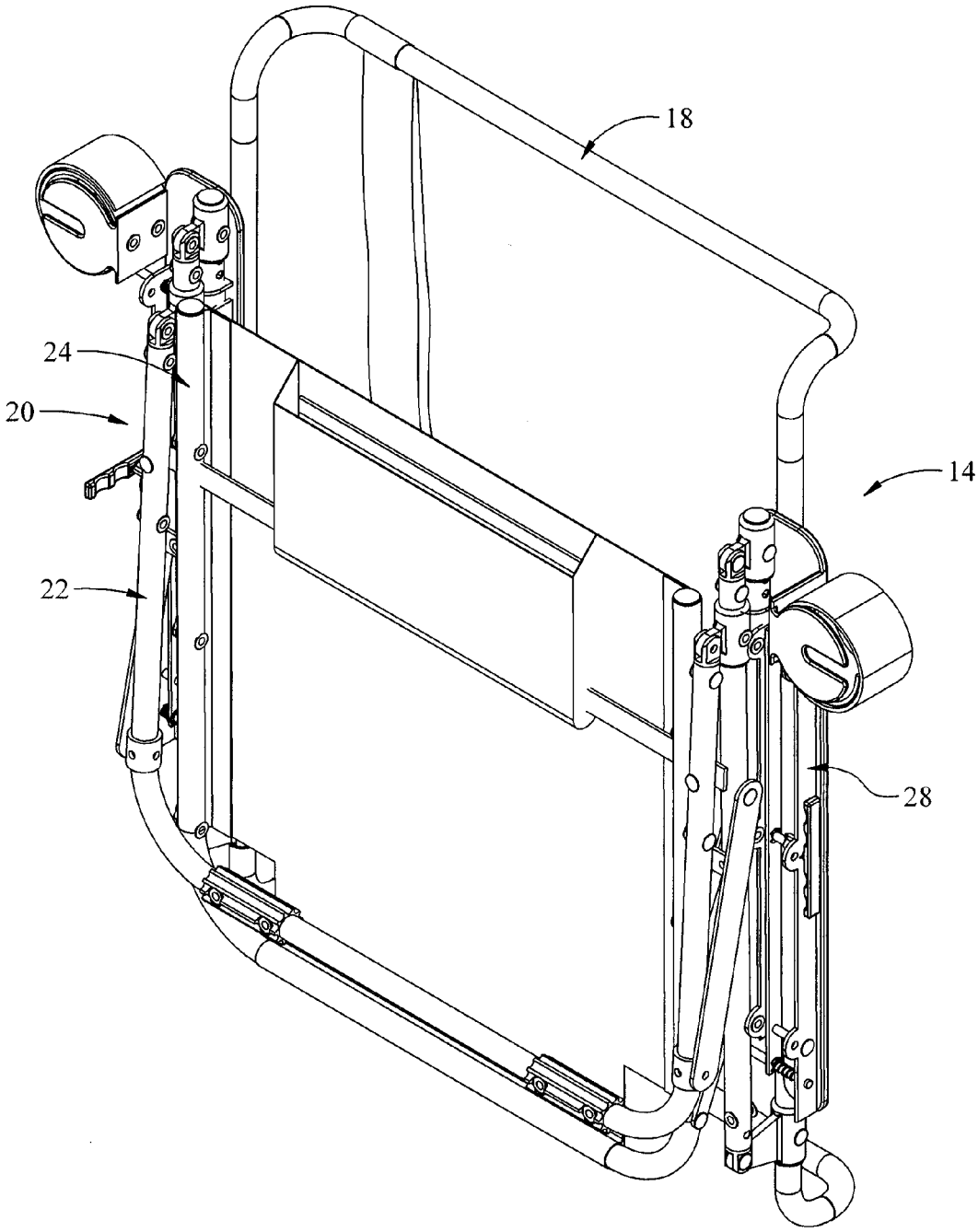
FIG. 21 is a left side isometric view of the chair in the collapsed assembly.
Figure 22:
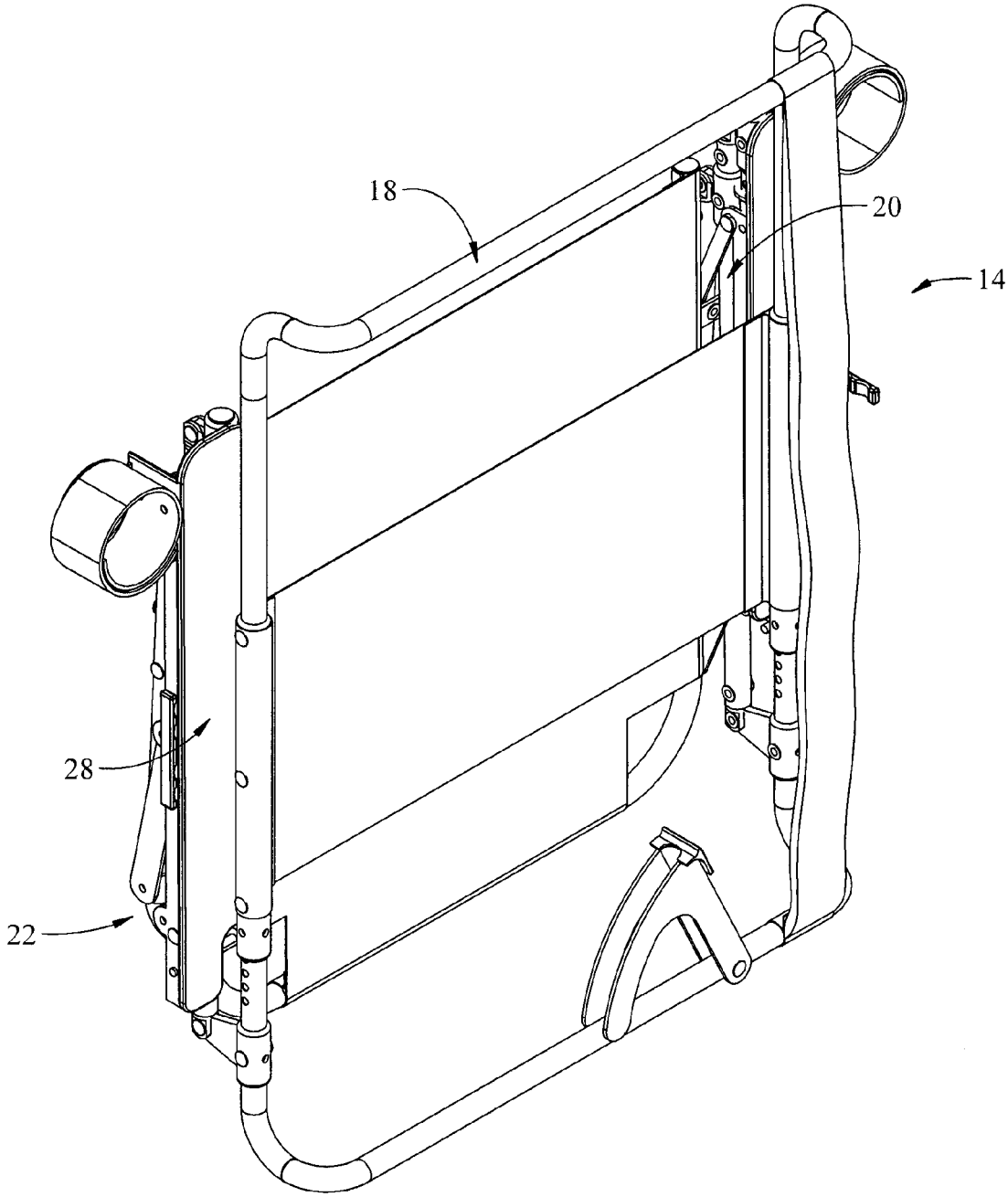
FIG. 22 is a right side isometric view of the chair in the collapsed position.
Figure 23:
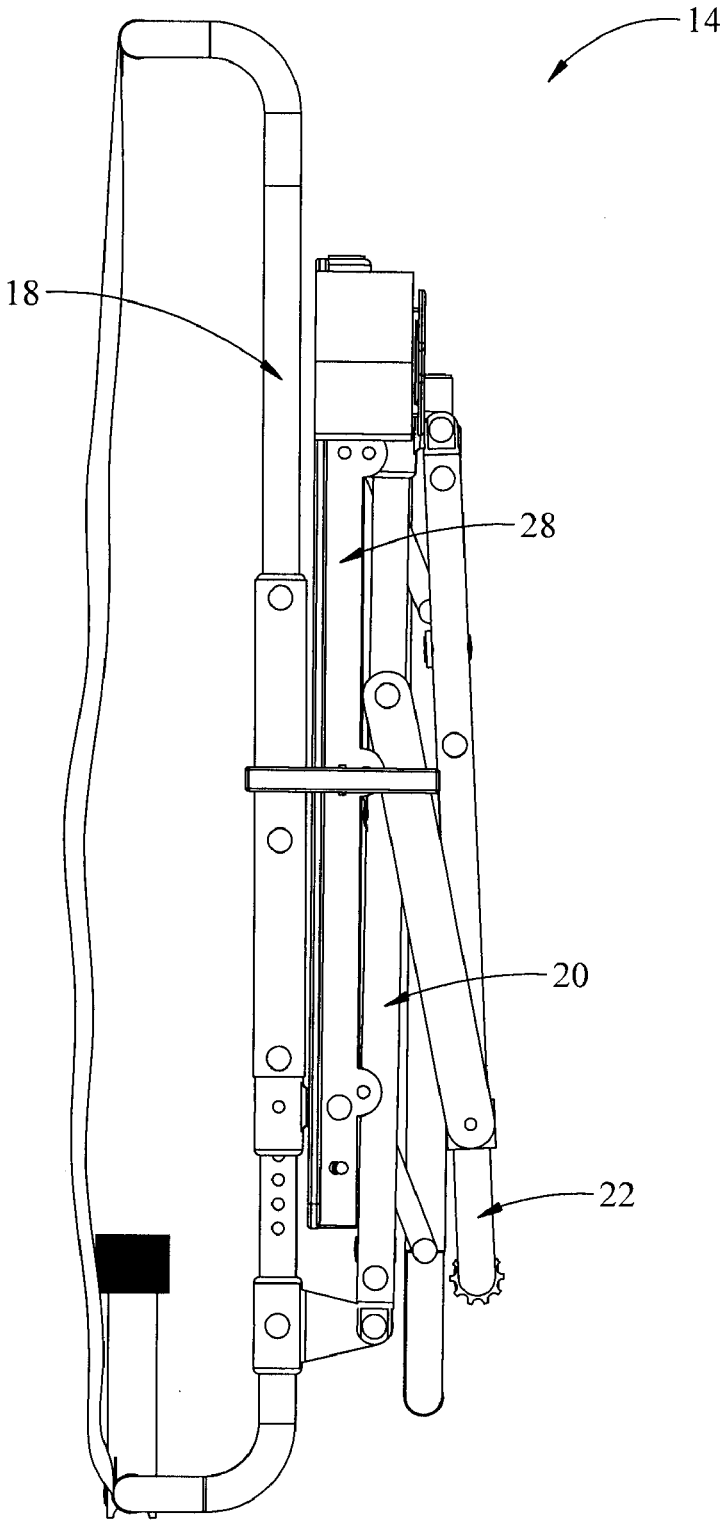
FIG. 23 is a side elevational view of the chair in the collapsed position.

Referring to the drawings, a chair A (FIG. 1) folds by a plurality of hinges 10 between an expanded position 12 and a collapsed position 14 (FIG. 21) to seat a person substantially horizontal while the chair A is positioned in the expanded position 12 on a surface 16 such as a hill which may be angled (FIG. 3). The chair A can be of any size to accommodate users of any size. The hinges 10 comprise moveable joints which pivot or rotate around a connecting member such as a pin.

The chair A comprises a back assembly 18, a support assembly 20, a leg assembly 22, a seat assembly 24 having a seat 26 and an arm assembly 28 (FIG. 3). In one embodiment, the chair A includes an anchor 30 which is configured to penetrate the angled surface 16 in order to adhere the chair A with the angled surface 16. Further, in an embodiment, the chair A includes a stabilizer foot 160 which is configured to contact the surface 16 in order to stabilize the chair A on the surface 16. Any anchoring, stabilizing or supporting member that can be employed to anchor/stabilize/support the chair A is intended to be within the scope of the disclosure.

Referring to FIGS. 1-7, the back assembly 18 has a back frame 32 and a back covering 34 that partially covers the back frame 32. The back frame 32 includes opposing back side members 36 wherein each back side member 36 has a first back end 38 and a second back end 40. The back frame 32 further includes an upper cross member 42 and a lower cross member 44. The upper cross member 42 connects together the back side members 36 at curved portions of the respective first back ends 38. The lower cross member 44 connects together the back side members 36 at curved portions at the respective second back ends 40.

Figure 12:
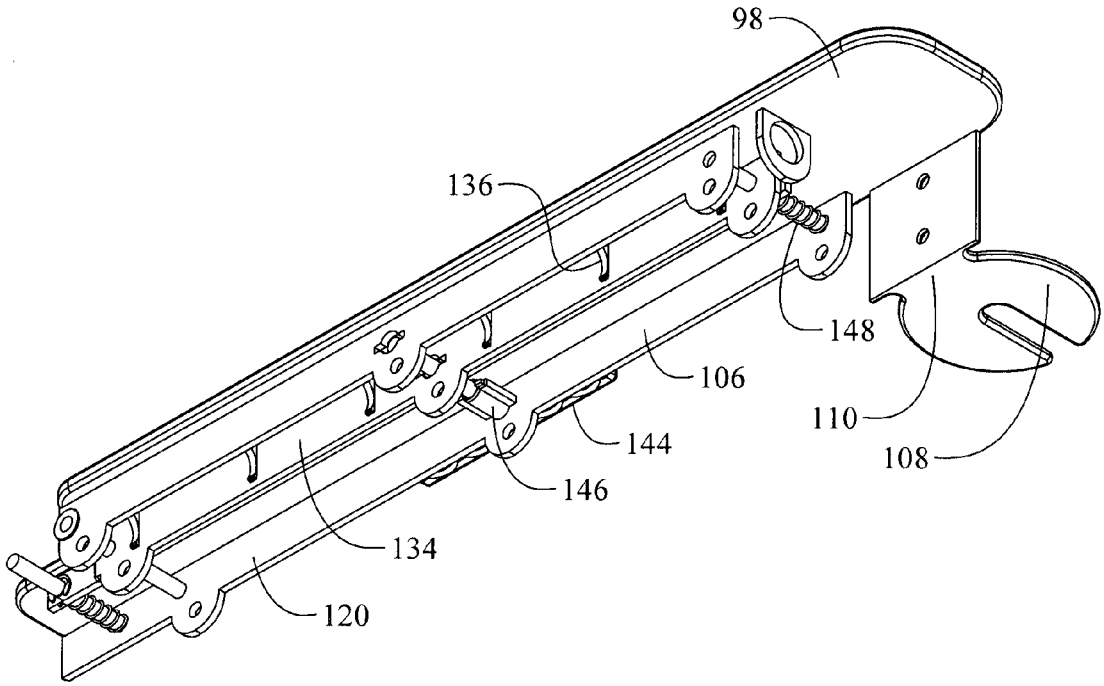
FIG. 12 is a bottom partial perspective view of the arm assembly illustrating the track support assembly, brackets channel and locking assembly.
Figure 13:
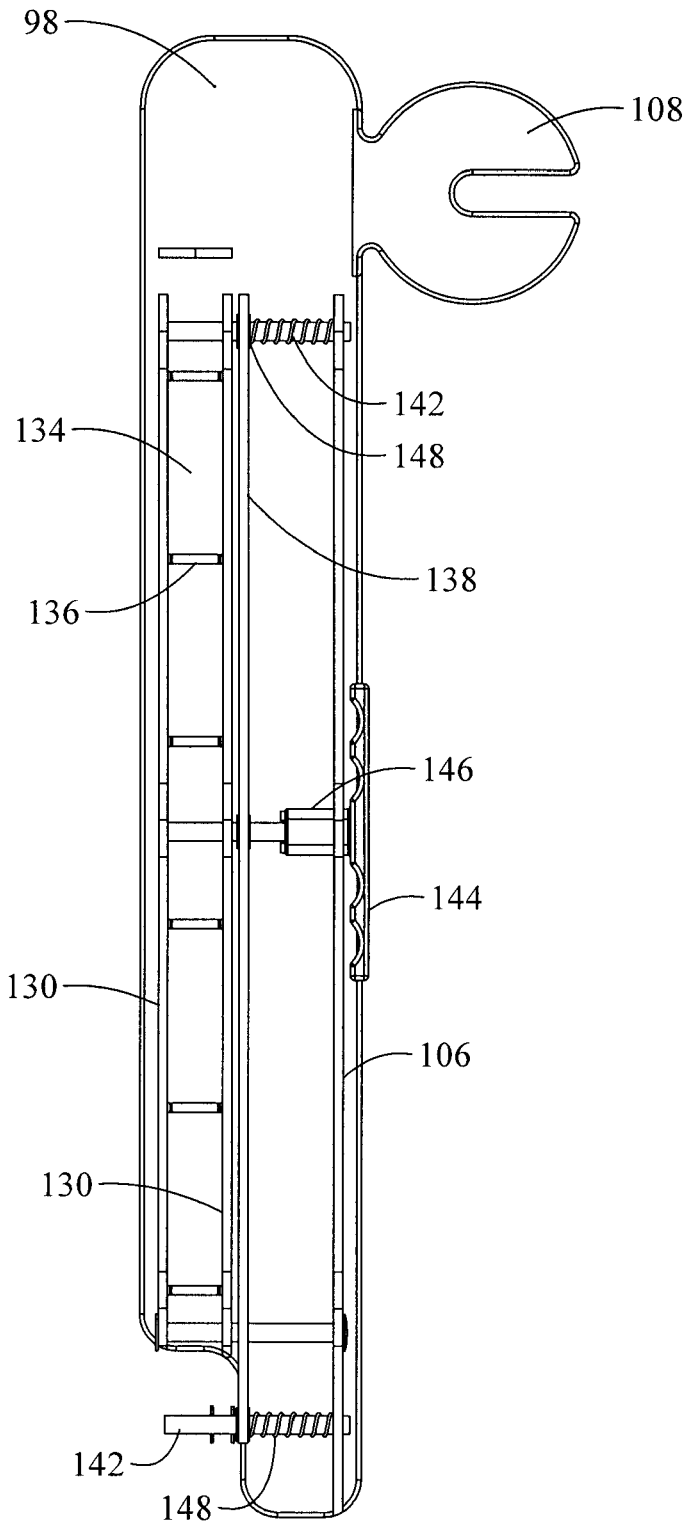
FIG. 13 is a bottom partial view of the arm assembly.
Figure 14:
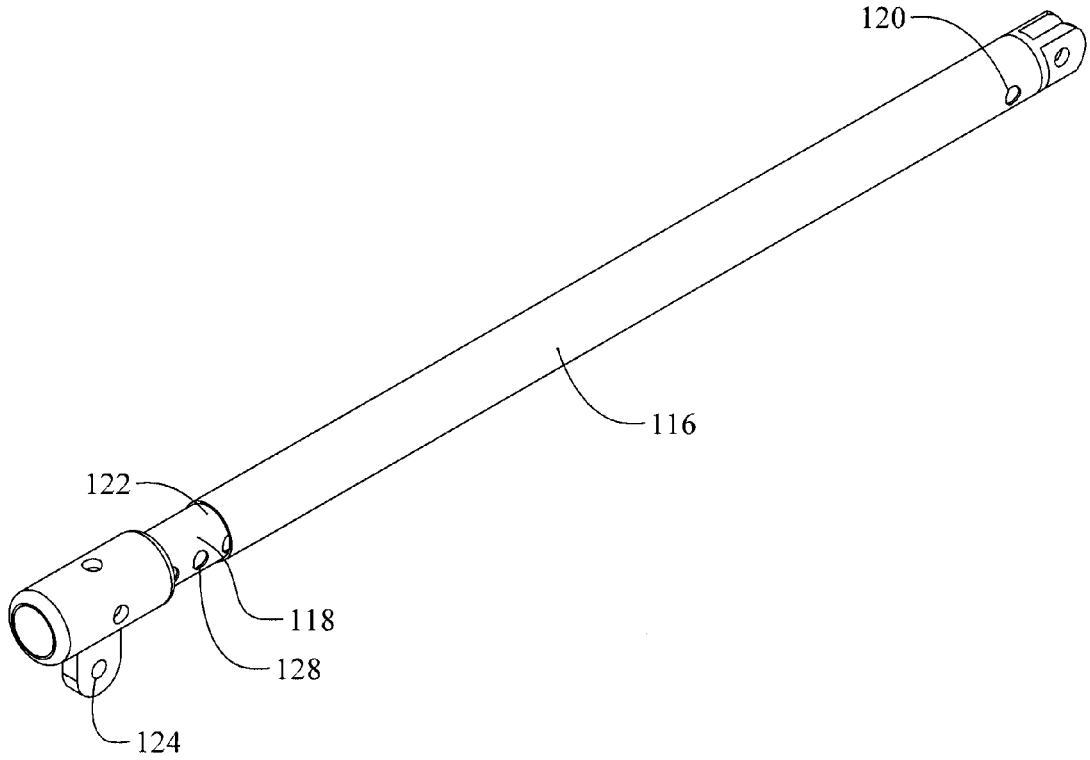
FIG. 14 is a partial perspective view of the outer telescoping member and inner telescoping member and hinge connectors of the arm assembly.
Figure 15:
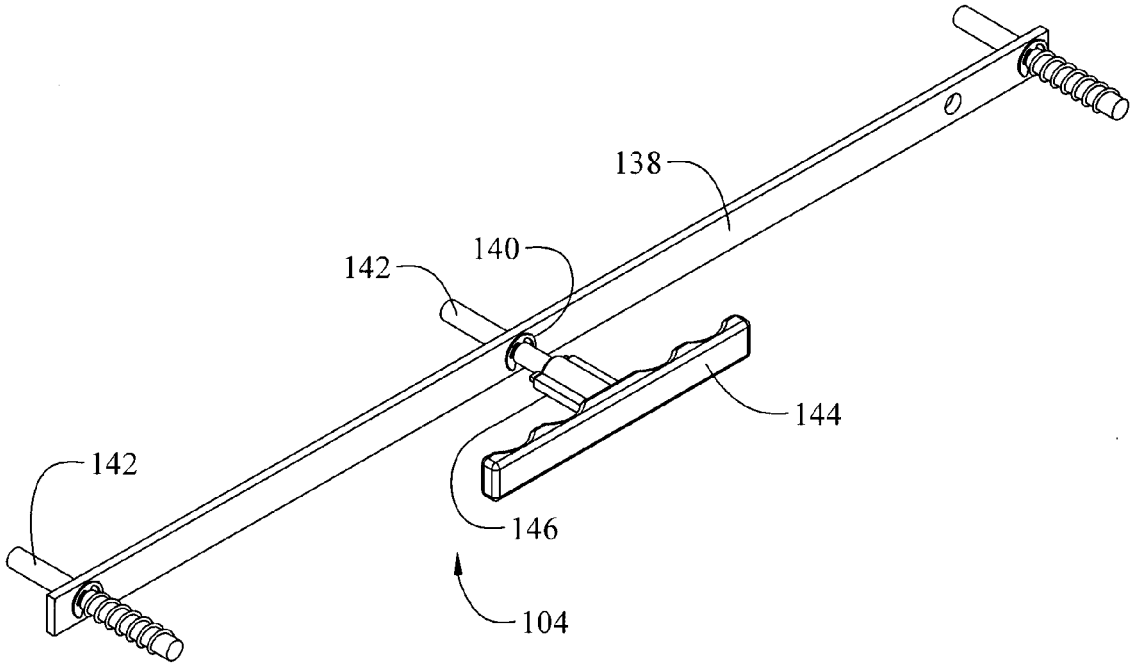
FIG. 15 is a partial isometric view of the locking assembly illustrating the linkage bar, lock handle, engagement pins and associated springs.
Figure 16:
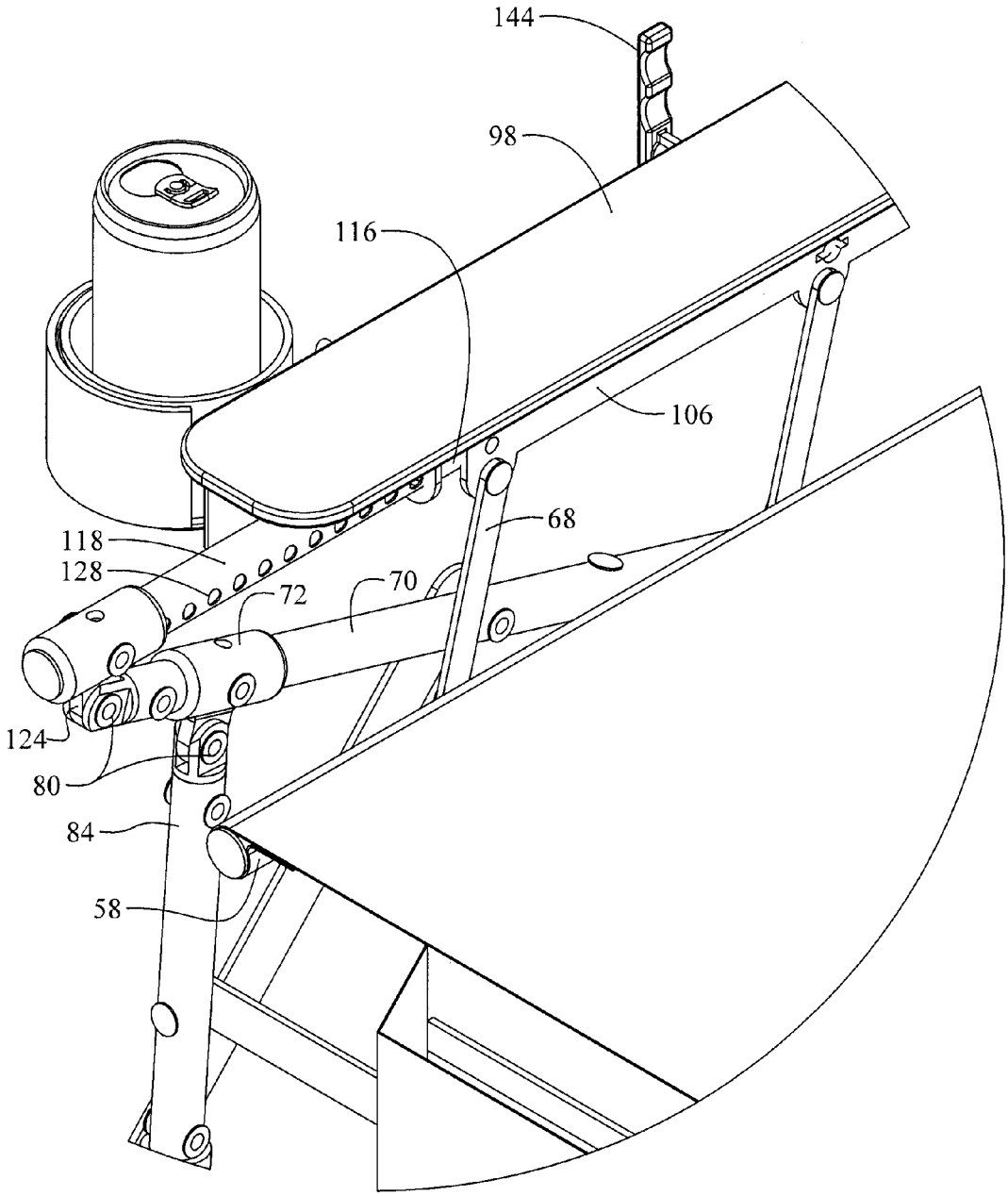
FIG. 16 is a partial isometric view of the intersection of the support side member, leg member, and inner telescoping member and further illustrating the rotatable hangers suspending the seat.
Figure 17:
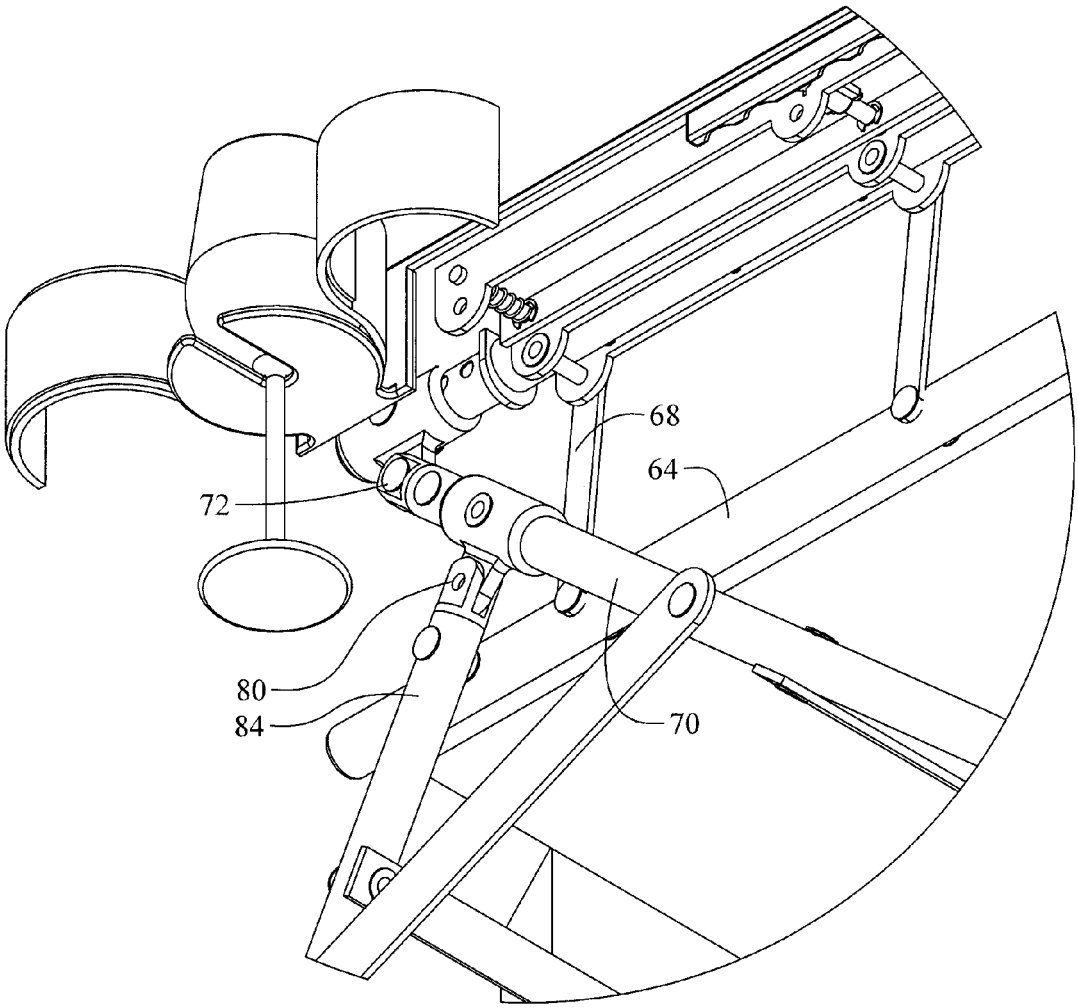
FIG. 17 is a bottom perspective view of FIG. 16.
Figure 18:
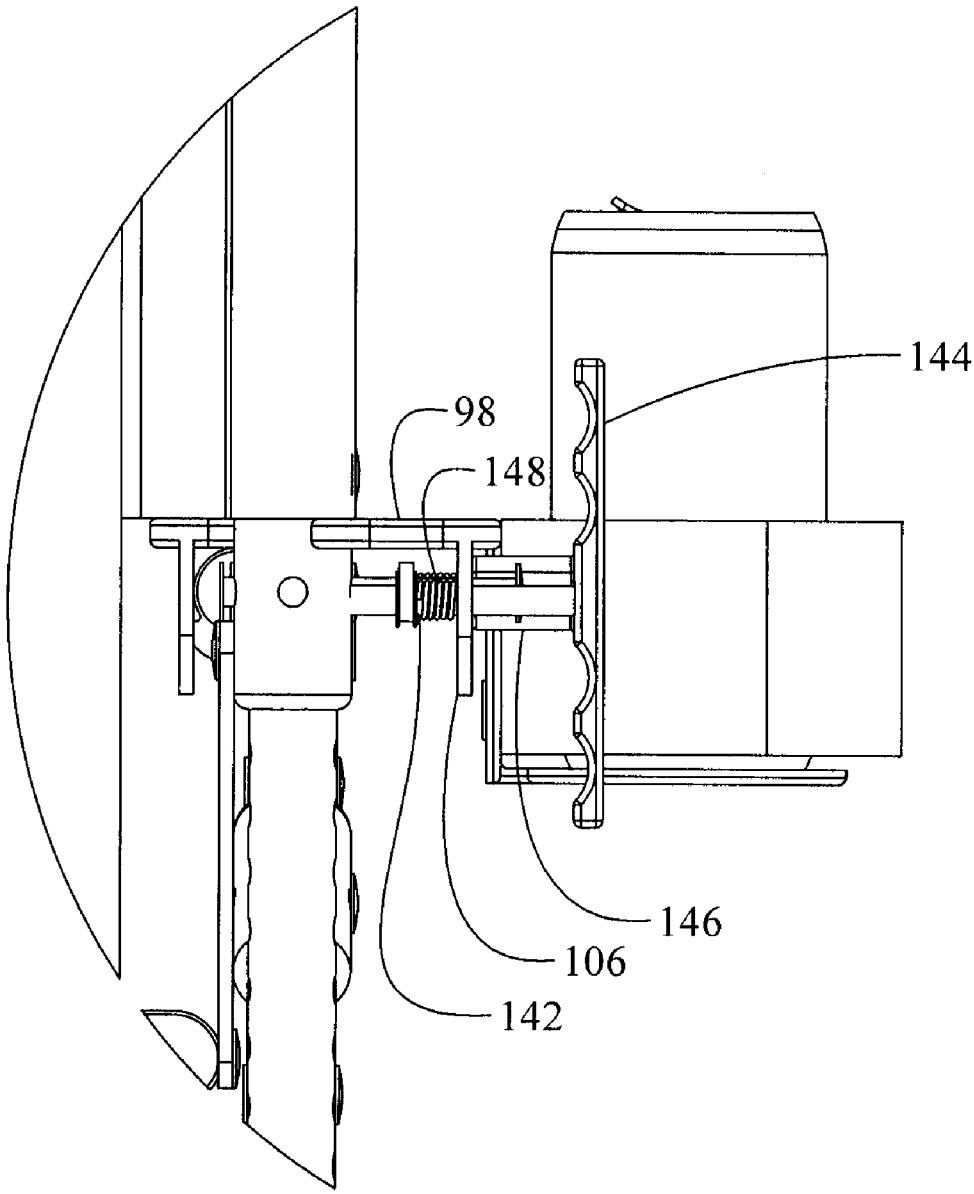
FIG. 18 is a partial front view of the locking assembly and the hanger bracket.
Figure 19:
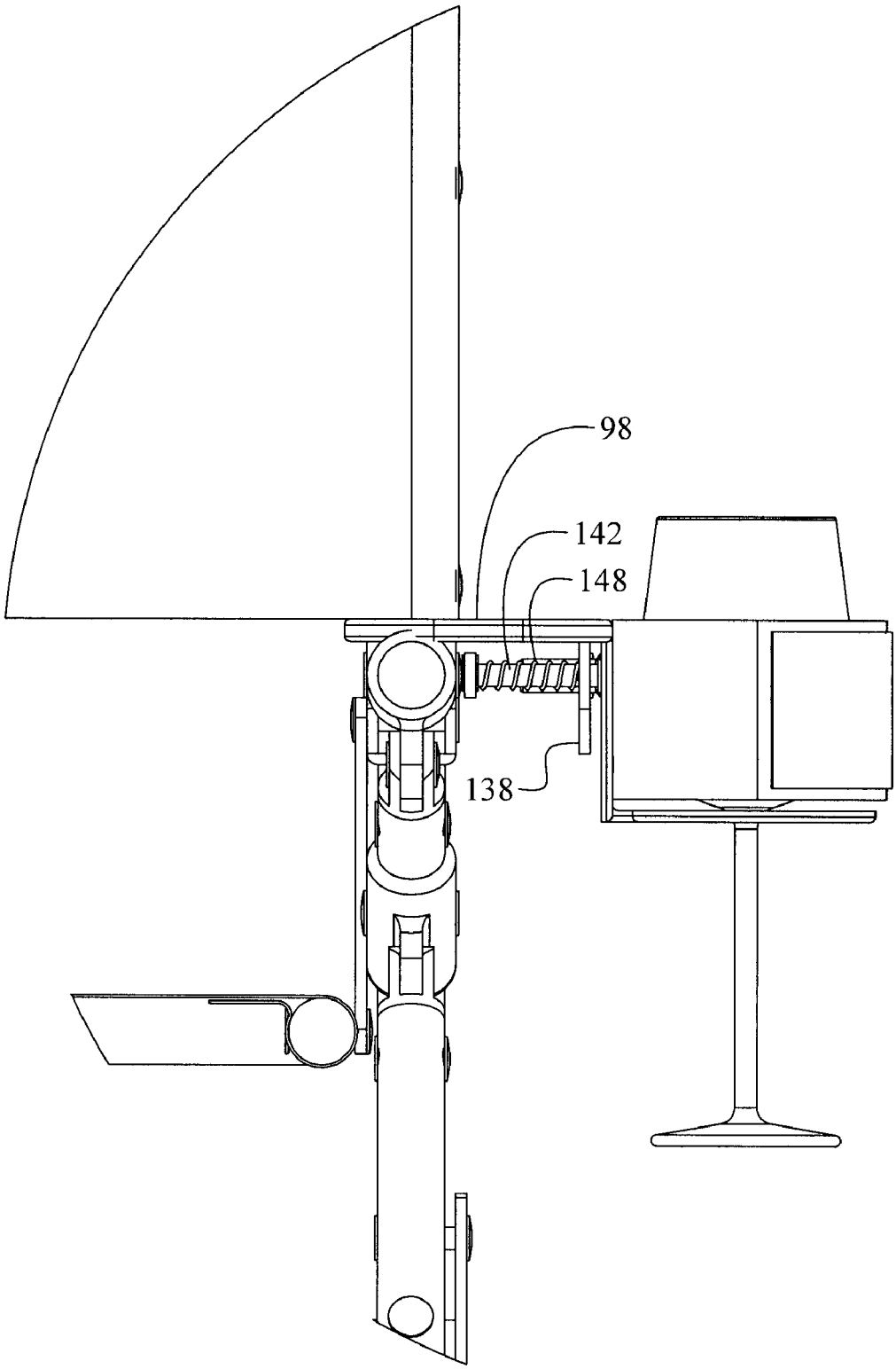
FIG. 19 is another partial front view of the locking assembly and the hanger bracket.
Figure 20:
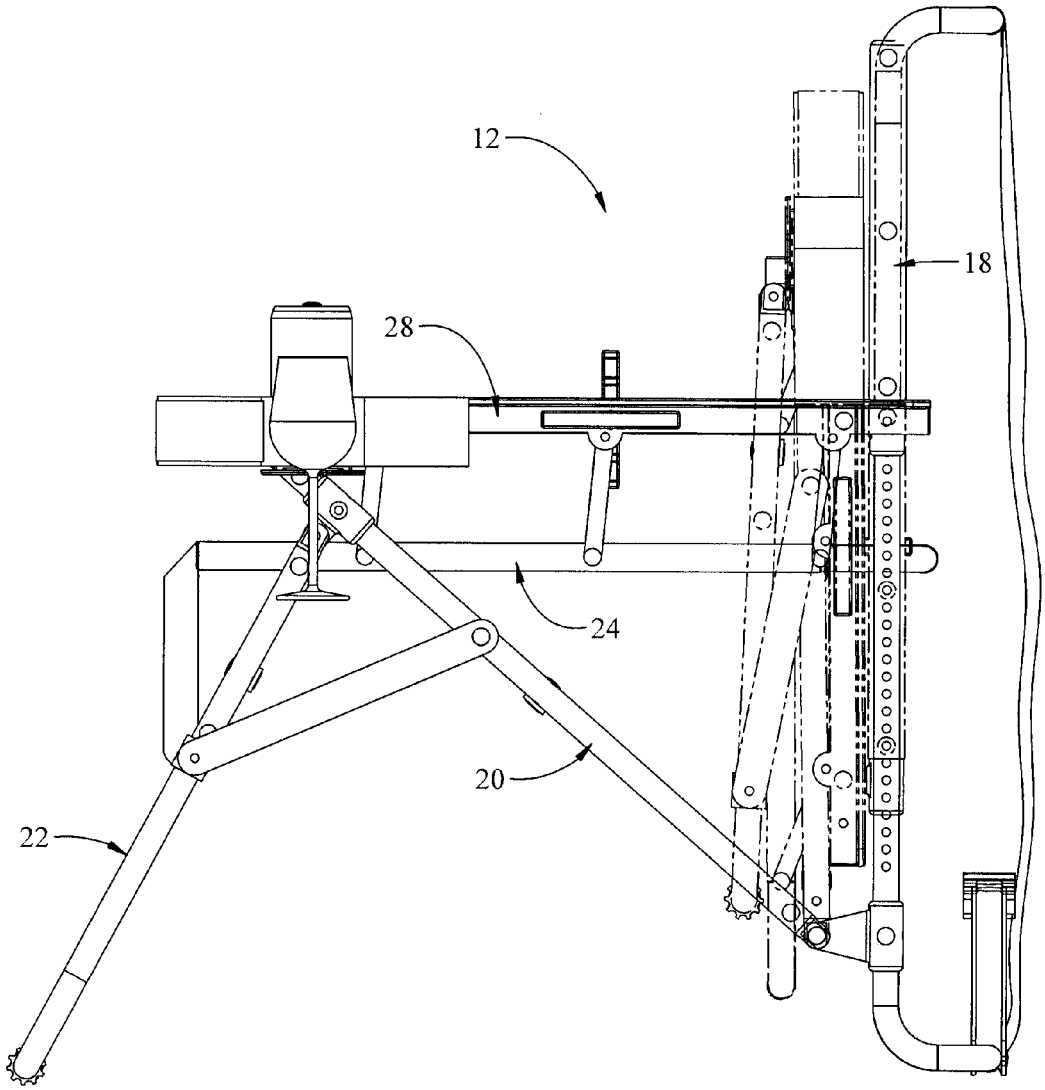
FIG. 20 is a side elevational view of the chair in the expanded position and the chair shown in phantom lines in the collapsed position illustrating the back assembly, support assembly, leg assembly, seat assembly and arm assembly.

Each back side member 36 includes a pair of telescoping members 46, 48 wherein one member telescopically reciprocates into or around the other member. The inner member 48 includes a plurality of apertures 52 defined there through. The other member 46 has a hinged connector 50 that operatively connects with the arm assembly 28. This member 46 further includes an engagement aperture 51 defined there through and sized and shaped or configured to accept an engagement pin 54 (FIG. 12). The engagement pin 54 fits within engagement aperture 51 and one of the selected apertures 52 of member 48 to removably connect members 46, 48 at a selected position or height. During use, the user can move member 46 either up or down around member 48 to a desired height or position and can insert the engagement pin 54 through members 46, 48 via the respective apertures 51, 52.

The apertures 52 of the inner member 48 form a seat track 70 that is integrally disposed within the back side members 36. The seat track 70 of one of the back side members 36 contains a mirror configuration of the seat track 70 for the other respective back side member 36. Since the seat track 70 is integrally disposed within the back side members 36, the seat track 70 does not extend beyond the back frame 32. The apertures 52 of the seat track 70 form a plurality of seat adjustment positions, wherein the seat adjustment positions are located between the back covering 34 and the second back end 40.

Figure 1:
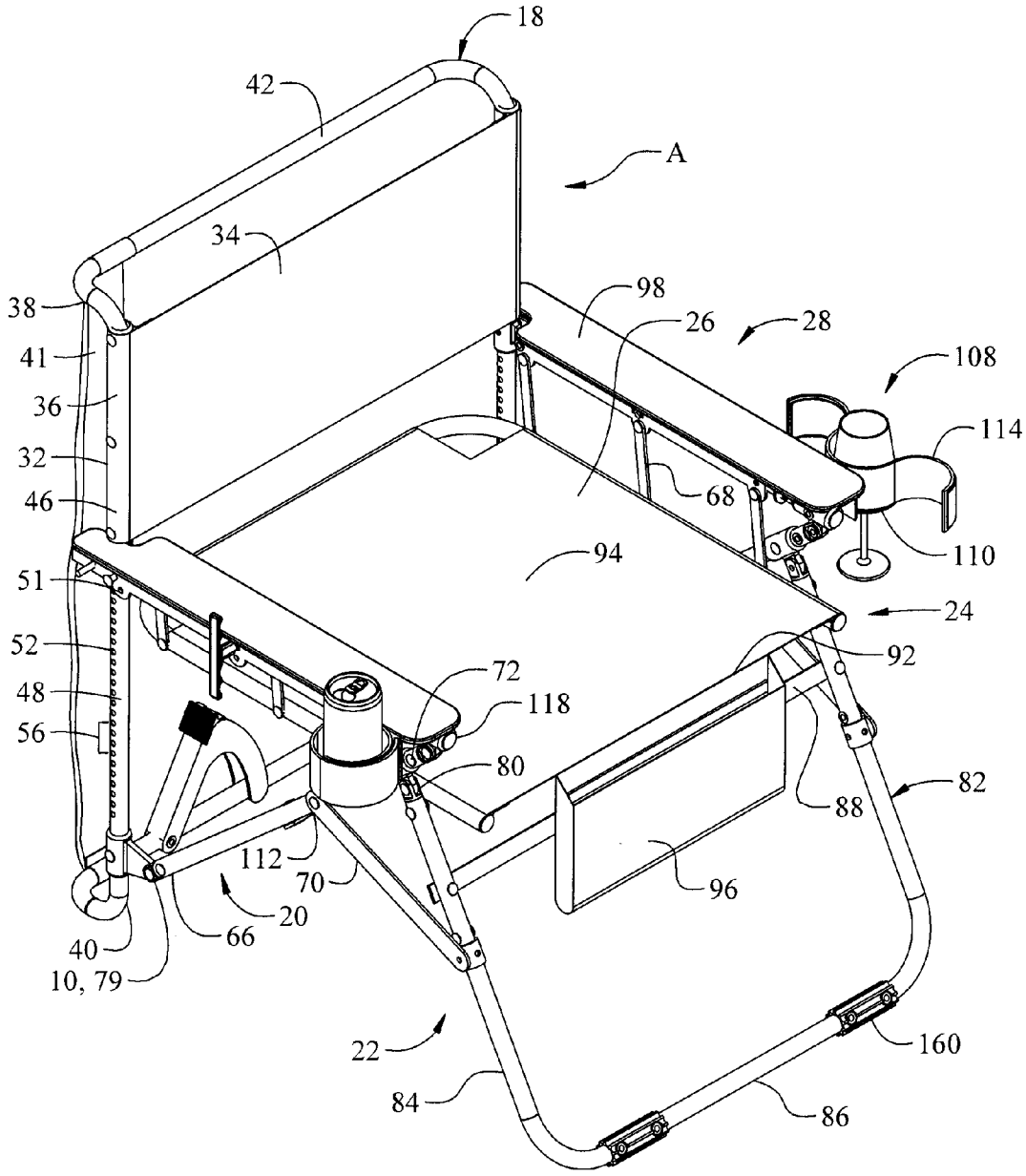
FIG. 1 is a left side, perspective view of the chair constructed in accordance with an embodying the disclosure illustrating a back assembly, support assembly, leg assembly, seat assembly and arm assembly.
Figure 2:
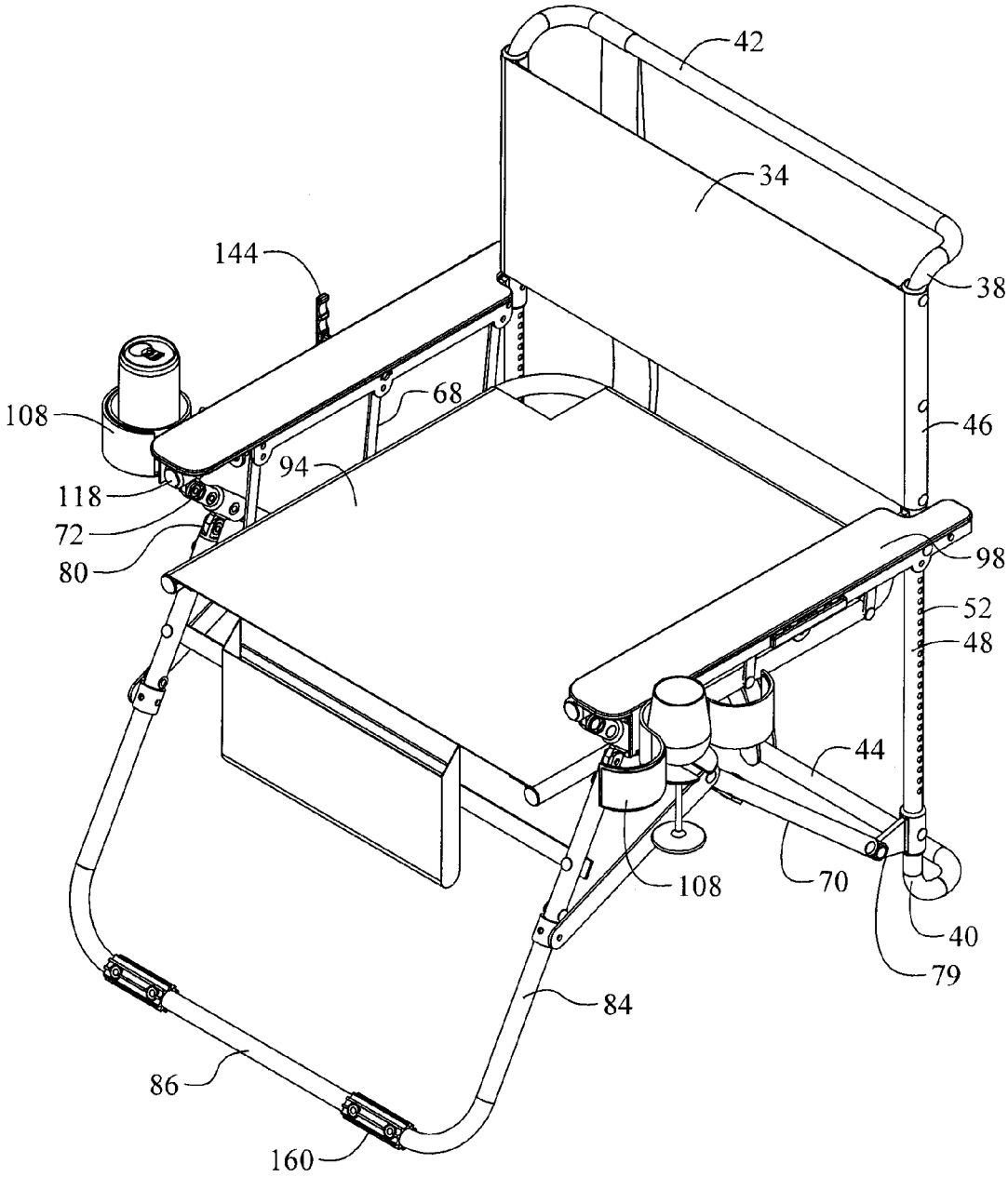
FIG. 2 is a right side perspective view thereof.

The back covering 34 partially covers the back frame 32 wherein the back covering 34 comprises any suitable material such as nylon or canvas. As shown in FIG. 1, the back covering 34 operatively connects to and in a position between the back side members 36. In an embodiment, fasteners such as rivets connect the back covering 34 to the side members 36. The back covering 34 may include reinforcement strips of material to provide a resistant back support for the user.

Figure 8:
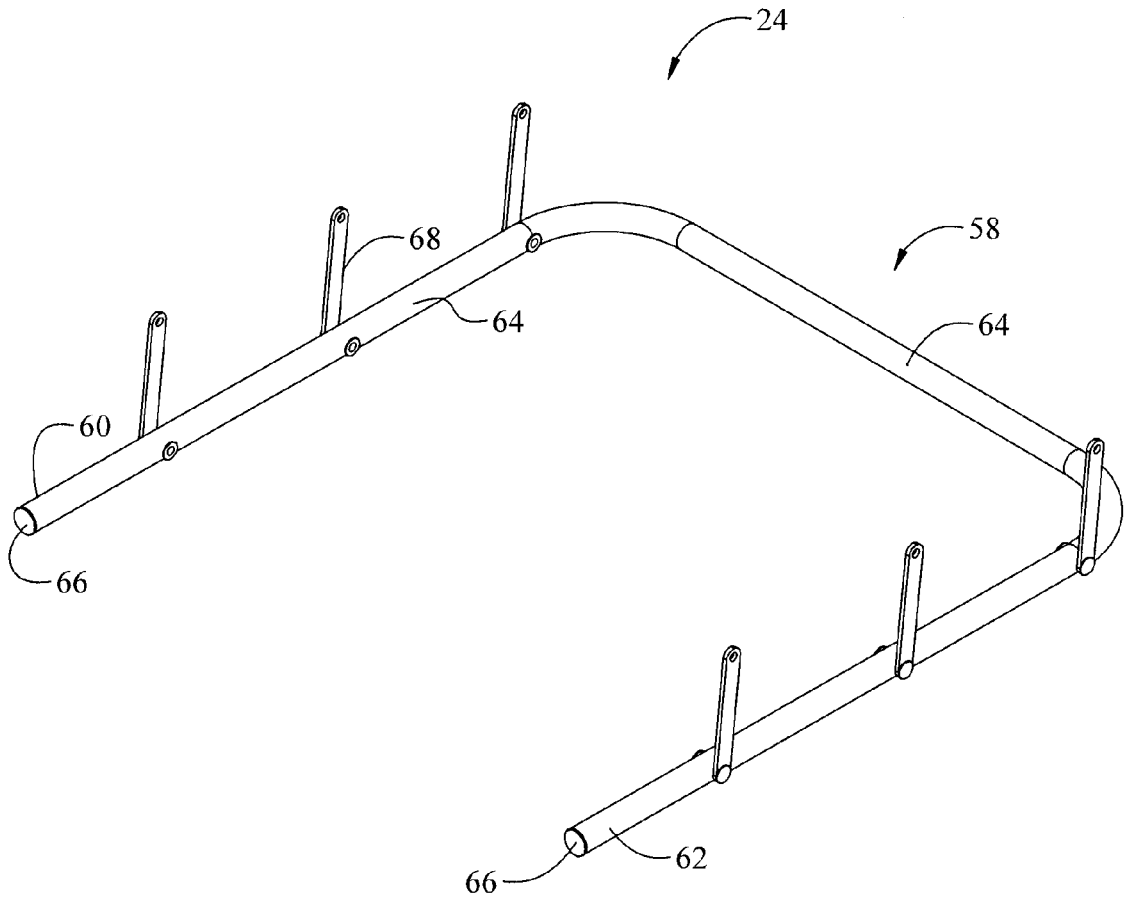
FIG. 8 is a partial view of the seat assembly illustrating a seat frame having a first end, second end and a body disposed there between and illustrating hangers connected to the body.

Turning to FIG. 8 and referring to FIG. 1, the seat assembly 24 includes a seat frame 58 configured to operatively connect with the arm assembly 26. The seat frame 58 has a first end 60, a second end 62 and a body 64 disposed there between. End caps 66 close and seal the first end 60 and the second end 62. In one embodiment, the seat frame 58 is U-shaped. The seat assembly 24 further includes a seat hanger 68 operatively connected to the body 64. In an embodiment, a plurality of hangers 68 connects to the body 64.

Figure 9:
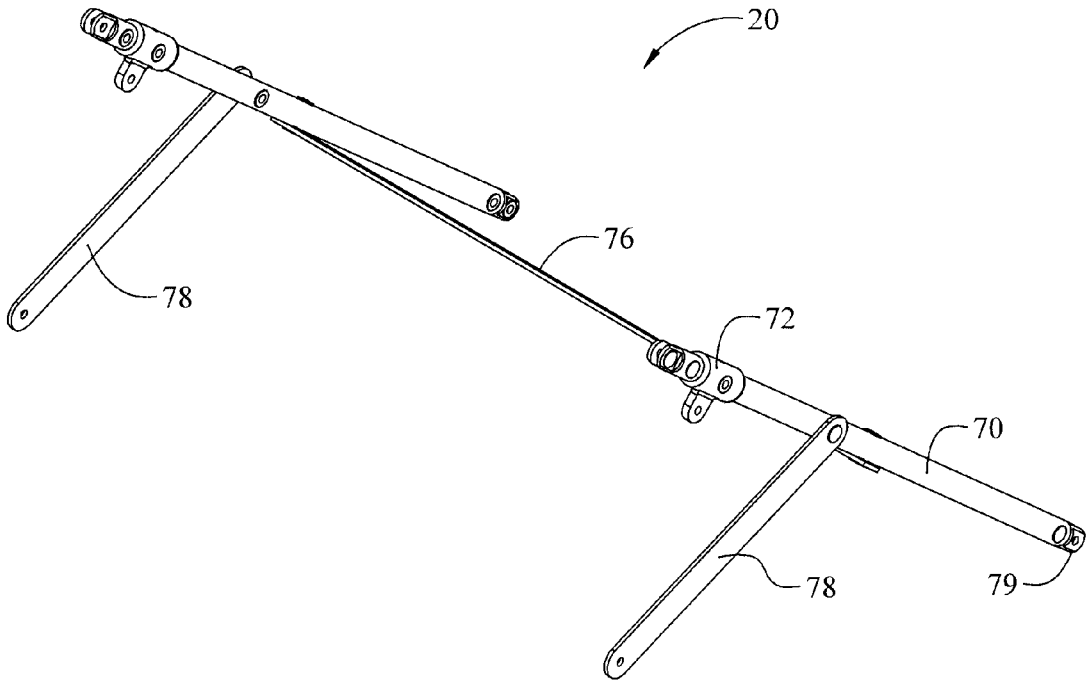
FIG. 9 is a partial isometric view of the support assembly illustrating side support members and stabilizers.

The support assembly 20 (FIG. 9) operatively connects to the back assembly 18, the leg assembly 22 and arm assembly 26 via hinges 10. The support assembly 20 includes opposing side members 70. Each seat side member 70 has a first support end 72 and a second support end 74. Furthermore, the support assembly 20 includes a cross brace 76 which connects the support side members 70 and includes rotatable stabilizers 78 that connect the support side members 70 to the leg assembly 22. Seat hinges 79 of the plurality of hinges 10 rotatably secures the support assembly 20 to the back frame 32. In particular, the seat hinges 79 pivotally couple the second support end 74 to the second back ends 40 of the back side members 36. In one embodiment, each seat hinge 79 includes joints (not shown) that may be secured at a plurality of angular positions with respect to the ground surface 16. Support hinges 79 also rotatably secure the support assembly 20 to the arm assembly 28. In particular, support hinges 79 pivotally couple the first support ends 72 to the arm assembly 28.

Figure 10:
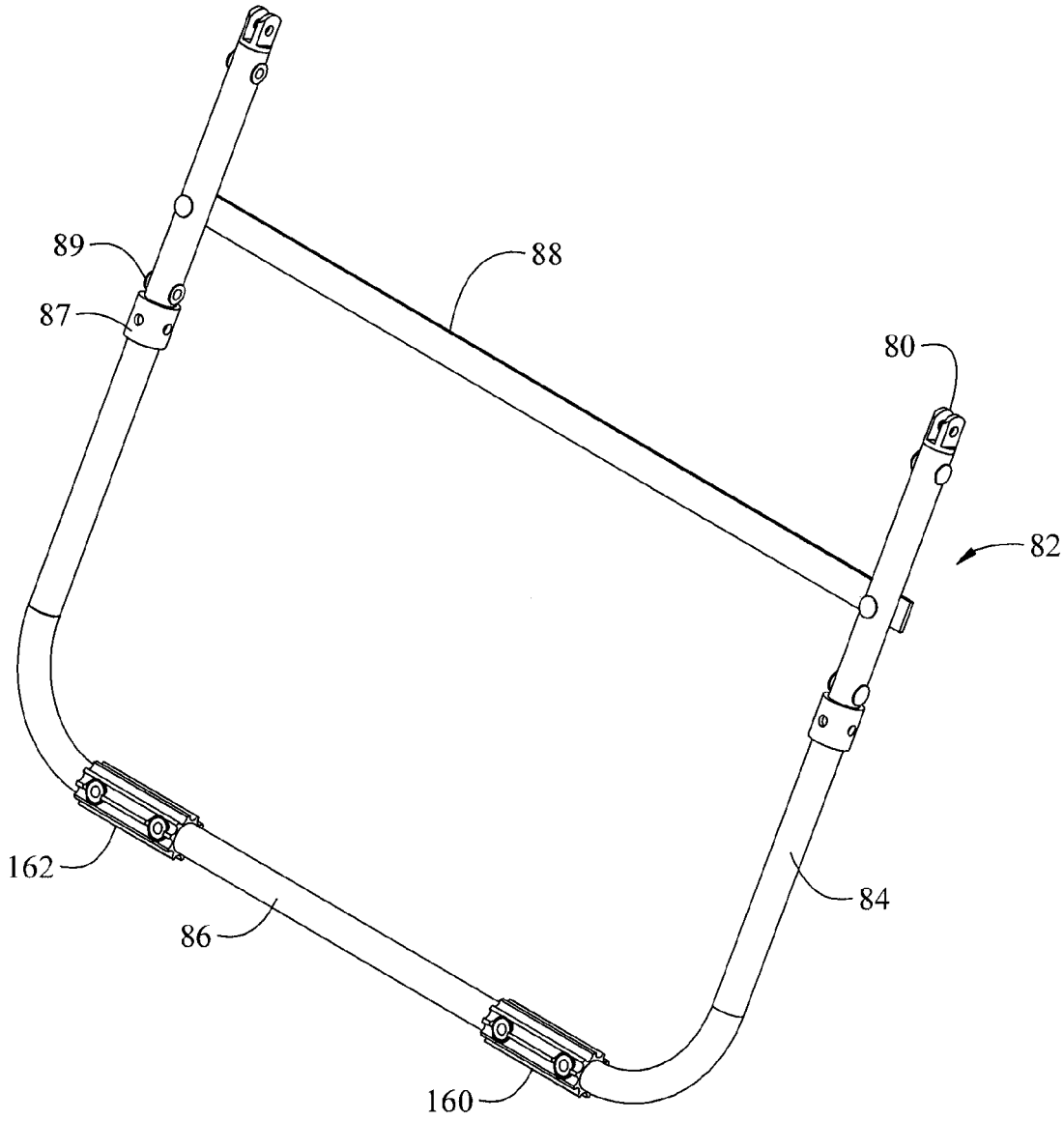
FIG. 10 is a partial isometric view of the leg assembly illustrating leg side members, slidable collars and stops.
Figure 11:
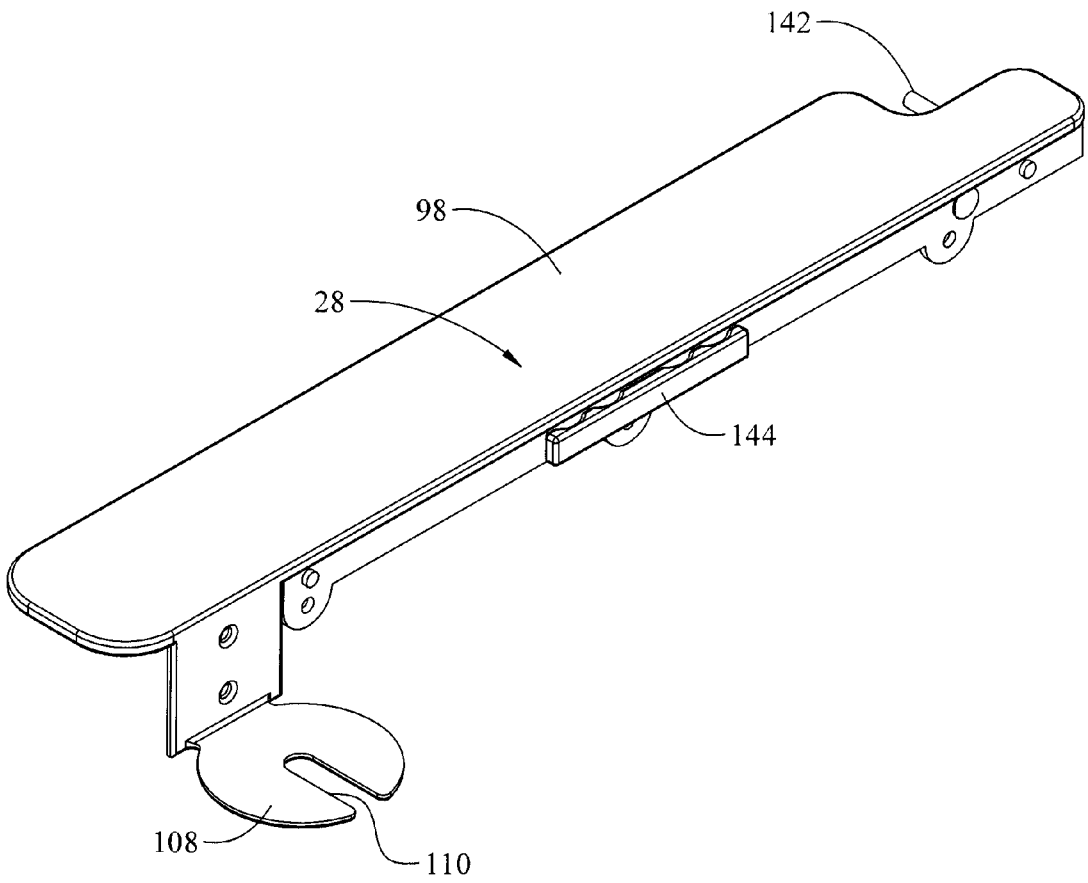
FIG. 11 is a partial isometric view of the arm assembly illustrating an arm rest, beverage holder, hanger bracket and handle of a locking assembly.

Turning to FIG. 10 and referring to FIG. 1, leg hinges 80 of the plurality of hinges 10 secures the leg assembly 22 to the support assembly 20. In particular, each leg hinge 86 pivotally couples the leg assembly 22 to the first support ends 72 of the support assembly 20. The leg assembly 22 has a leg frame 82 which includes opposing leg side members 84 connected by a bottom leg member 86 at curved portions of the bottom leg member 86. Further, the leg frame 82 includes a cross brace 88 which connects with the opposing leg side members 84. Each leg side member 84 attaches to the stabilizers 78 of the support assembly 20 via slidable collars 87 positioned around the leg side members 84. The leg side members 84 include stops 89 to prevent movement of the collars 87 around the leg side members 84 beyond a predetermined position along the leg side members 84.

Returning to FIG. 1, the seat 26 connects to the seat frame 58. The seat 26 has a proximal end 90, a distal end 92 and a body 94 positioned between the proximal end 90 and the distal end 92. The proximal end 90 is positioned on the seat frame 58 near the back assembly 18 while the distal end 92 is positioned near the leg assembly 22. The body 94 of the seat 26 comprises a collapsible fabric panel which may include any suitable material such as nylon or canvas material. In an embodiment, a flexible, storage container 96 suspends from the distal end 92 of the seat 26. The storage container 96 is sized and shaped or configured to store a variety of items such as, but not limited to, newspapers, magazines or books. Any storage container that can be employed to store items is intended to be within the scope of the invention.

Turning to FIGS. 11-19 and referring to FIG. 1, the arm assembly 28 comprises an arm rest 98, an arm track 100, a track support assembly 102, a locking assembly 104 and a hanger bracket 106.

The arm rest 98 includes a top surface, a bottom surface and side walls connecting the top surface and bottom surface. The armrest 98 further includes a beverage holder 108 connected thereto. In an embodiment, the beverage holder 108 is foldable along a hinge with respect to the arm rest 98 The beverage holder 108 includes a grooved surface 110 to accept a stem of glassware such as a wine glass. Alternatively, the beverage holder 108 includes a cupped surface 112 to accept the bottom of a beverage container such as a can. The beverage holder 108 may also include curved portions 114 that pressurably accept and hold a beverage container such as a can. The arm assembly 28 may include a variety of beverage holders 108 in an embodiment.

The arm track 100 includes an outer telescoping member 116 and an inner telescoping member 118. The outer telescoping member 116 has a hinge connector 120 on one end and is open at the opposite end 122. Hinge connector 120 rotatably connects with hinge connector 50 of the back side member 36. The inner telescoping member 118 is sized and shaped or configured to slide within the open end 122 of the outer telescoping member 116 to reciprocally move within the outer telescoping member 116. The inner telescoping member 118 further includes a body with a hinge connector 124 at one end of the body and is open at the other end of the body. The inner telescoping member 116 includes a plurality of apertures 128 defined through the body positioned between the ends of the body. Hinge connector 124 rotatably connects with the first support end 72.

The track support 102 assembly includes brackets 130 connected to the bottom surface of the armrest 98. The brackets 130 have plurality of apertures defined there through which are sized and shaped as configured to guide and accept lock pins 132. In an embodiment, a pair of apertures is spaced toward ends of each bracket 130 and an aperture is spaced near the middle of each bracket. A pair of brackets 130 is spaced from each other to form a channel 134 there between. Ribs 136 are positioned on the bottom surface of the armrest 98 and within the channel 134. The channel 134 is sized and shaped to accept the outer telescoping member 116 wherein the ribs 136 receive the outer telescoping member 116 and connect with the outer telescoping member 116. The hanger bracket 106 operatively connects with the hangers 68 of the seat assembly 24. In particular, the hangers 68 rotatably connect to the hanger bracket 106.

The locking assembly 104 comprises a linkage bar 138 having a plurality of apertures 140 defined there through. In an embodiment, a pair of apertures 140 is spaced near the ends of the linkage bar 138 and an aperture is spaced near the middle of the linkage bar 138. The apertures at the linkage bar align with the apertures of one of the brackets 130 forming the channel 136. The locking assembly 104 further comprises the lock pins 142 that are configured to insert through the apertures. The locking assembly 104 further includes a lock handle 144 with a keyed shaft 146 wherein the key shaft 146 is configured to insert within the middle aperture of the linkage bar 138. The keyed shaft 146 includes a lock pin 142 extending therefrom. The locking assembly 104 also includes springs 148 configured to partially surround the lock pins 142 positioned through the apertures near the end of the linkage bar 138. Fasteners, such as E-clips, assist in connecting the springs 148 to the locking pins 142.

The locking pins 142 of the locking assembly 104 are configured to insert through the apertures of the bracket 106 that is rotatably connected to the seat hangers 68, and continue through the apertures of the spaced brackets 130 forming the channel 134. These springs 148 are positioned between the hanger bracket 106 and the linkage bar 138.

Figure 7:
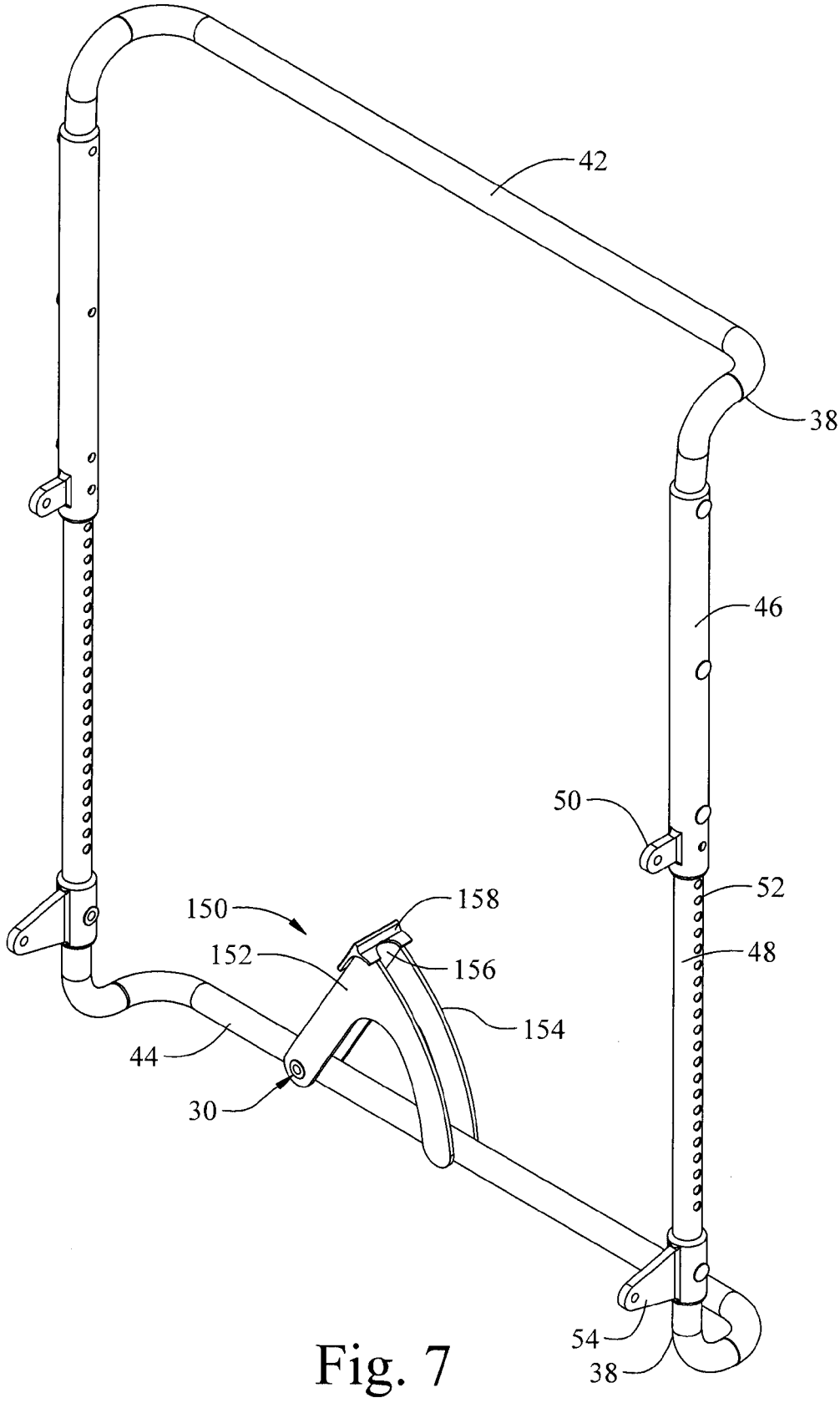
FIG. 7 is a partial view of the back assembly illustrating the upper and lower back members, back side members having a pair of telescoping members and an anchor.
Figure 24:
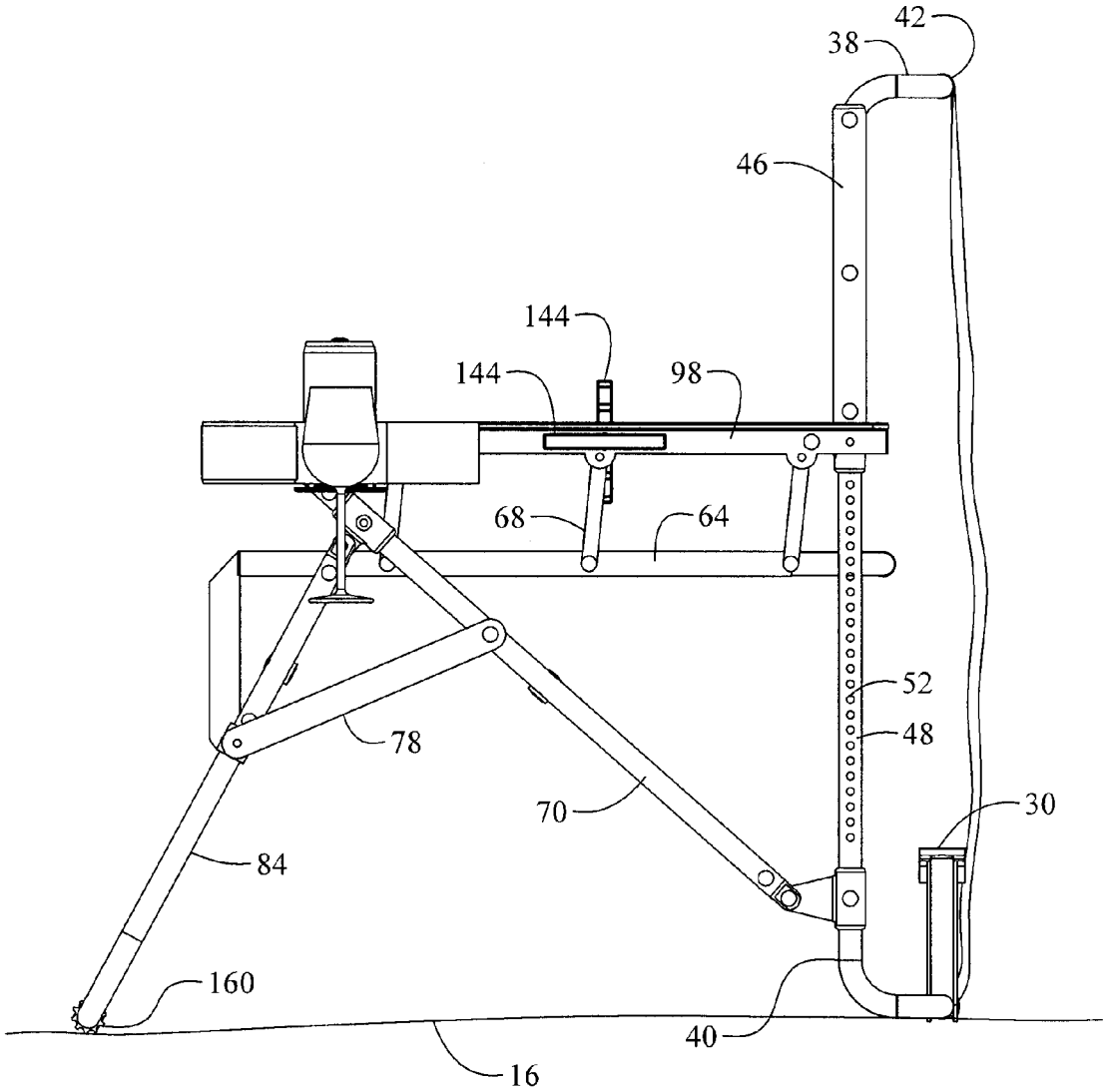
FIG. 24 is a side elevational view of the chair in the expanded position resting on a flat surface.
Figure 25:
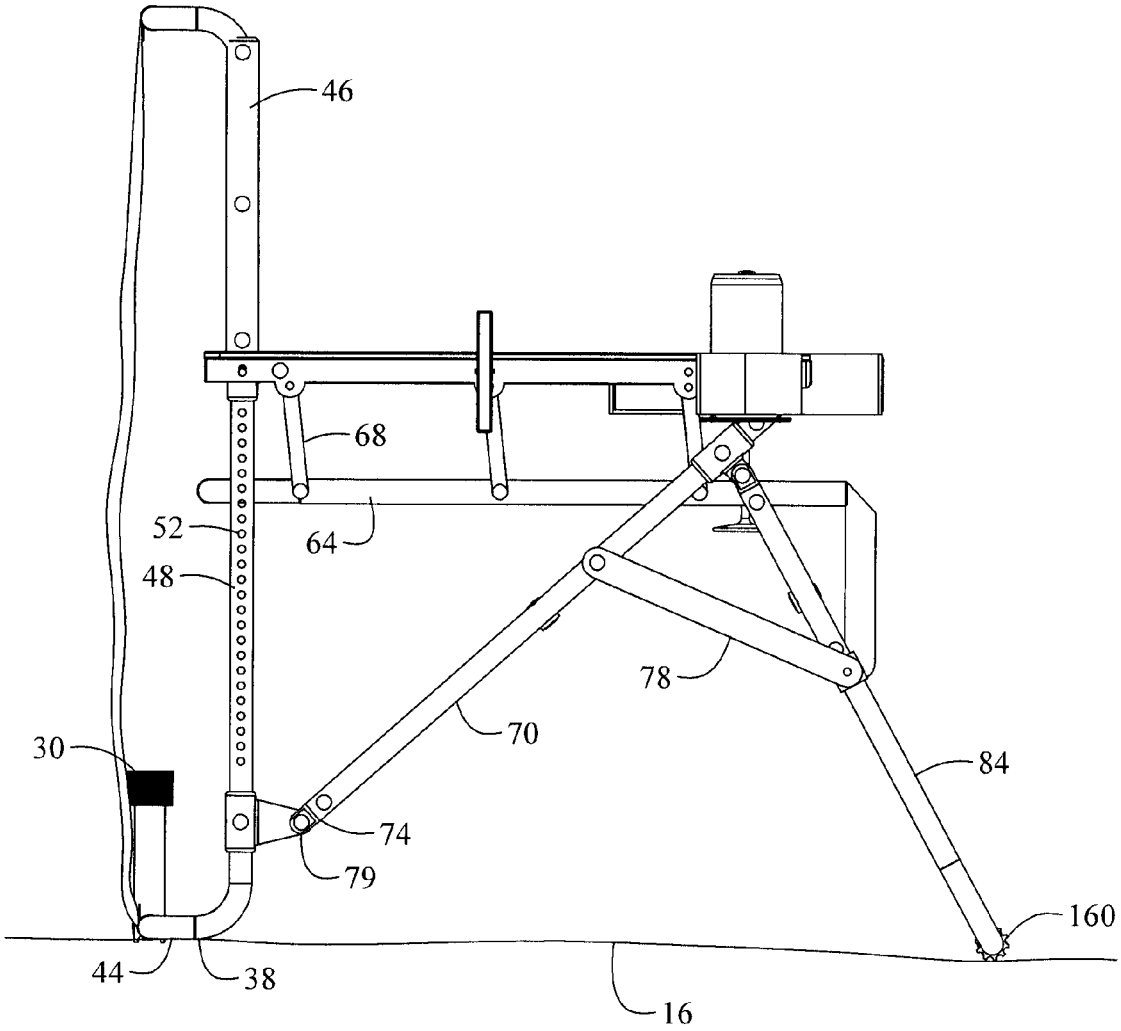
FIG. 25 is an opposite side elevational view of FIG. 24 showing the chair resting on the surface.
Figure 26:
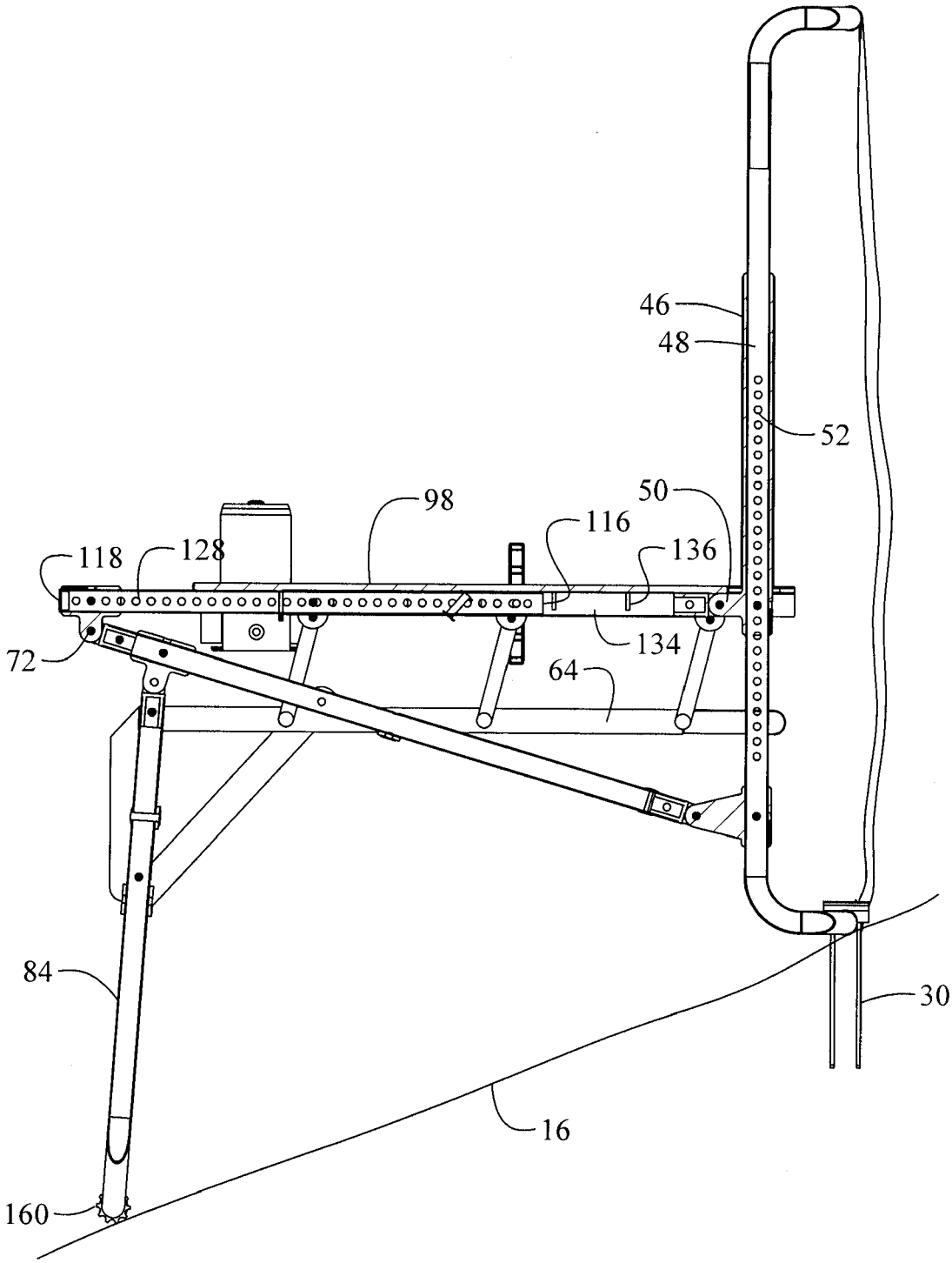
FIG. 26 is a side elevational view of the chair resting on an angled surface showing the anchor penetrating the angled surface.
Figure 27:
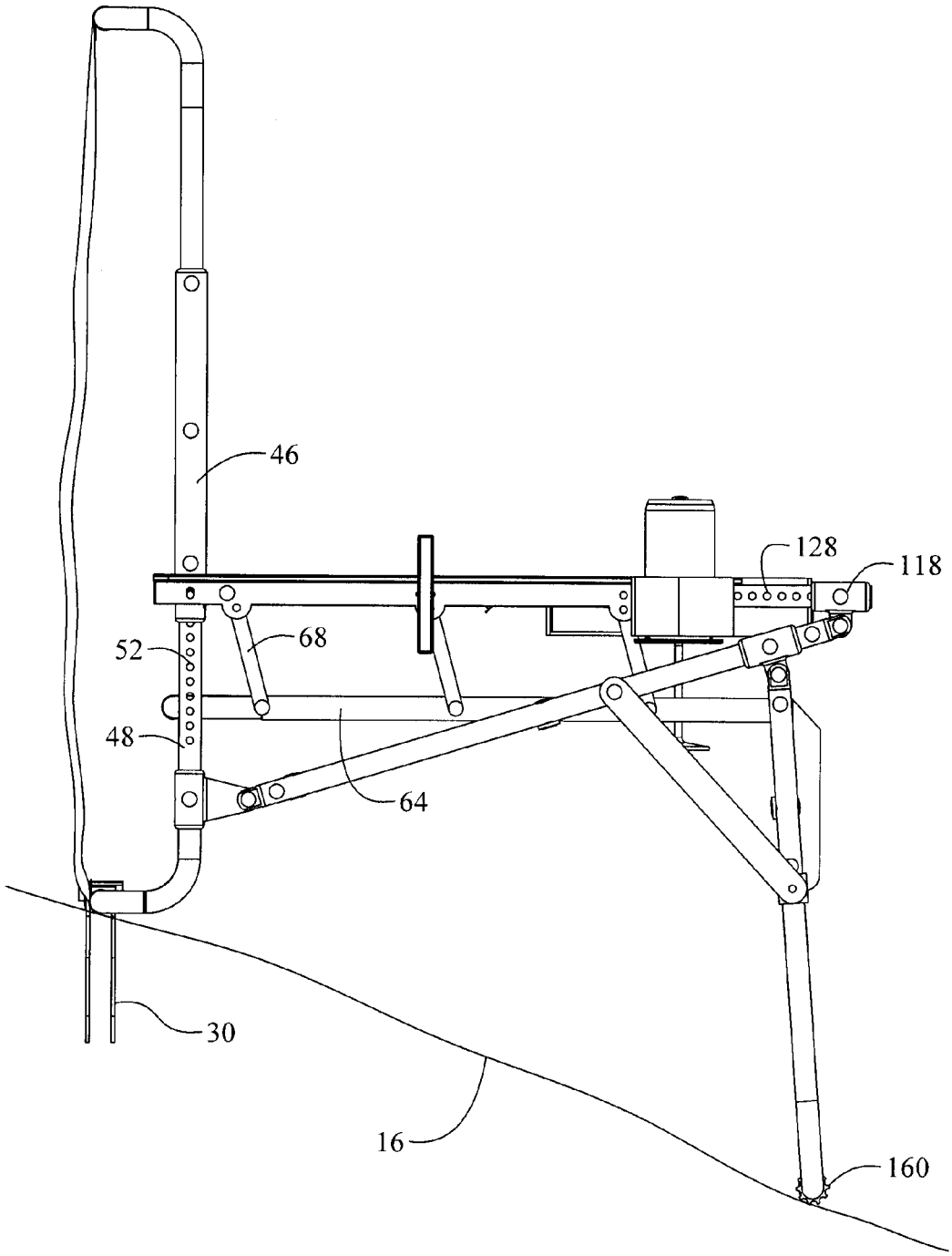
FIG. 27 is an opposite side view of FIG. 26.
Figure 28:
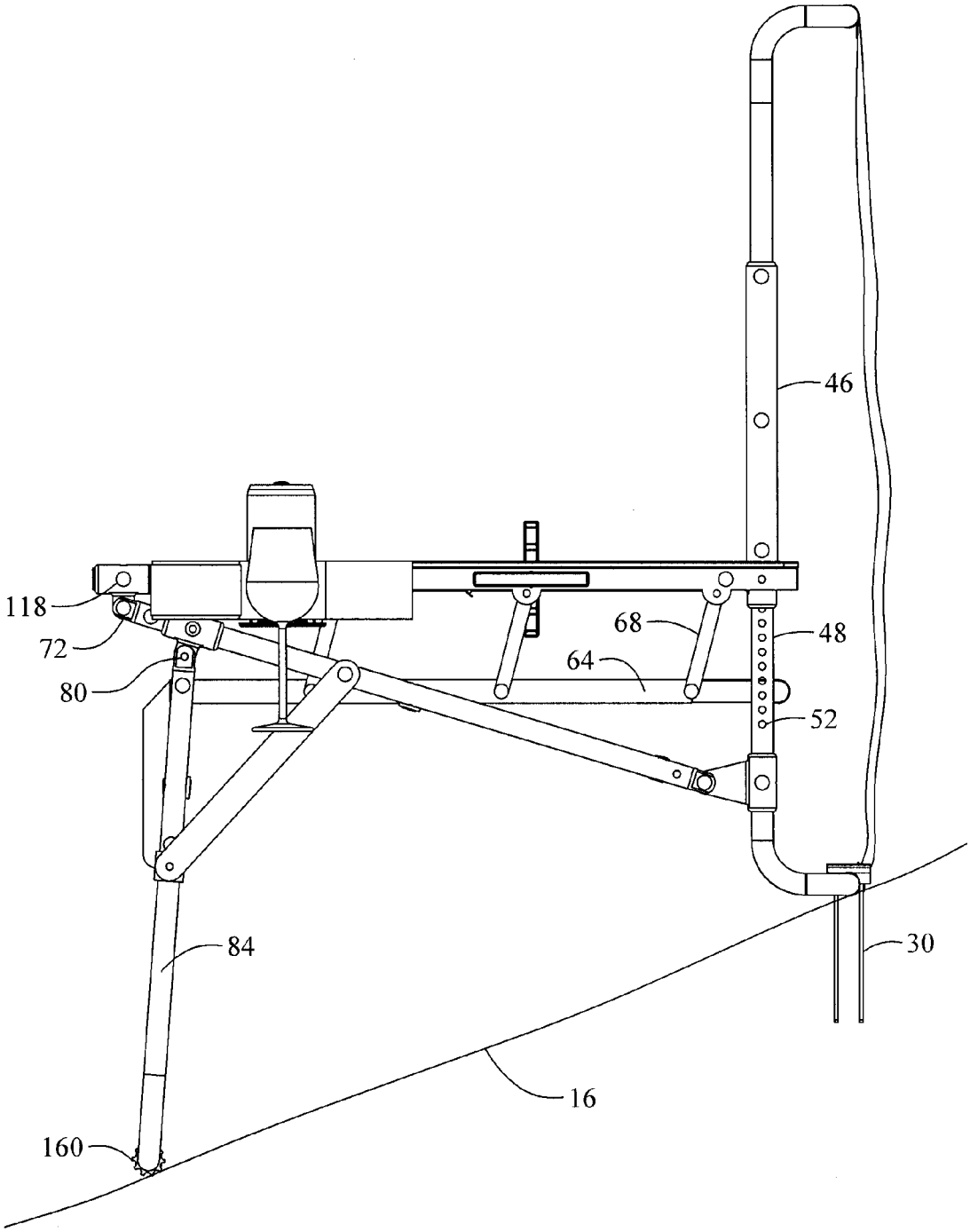
FIG. 28 is another side elevational view of the chair on the angled surface.
Figure 29:
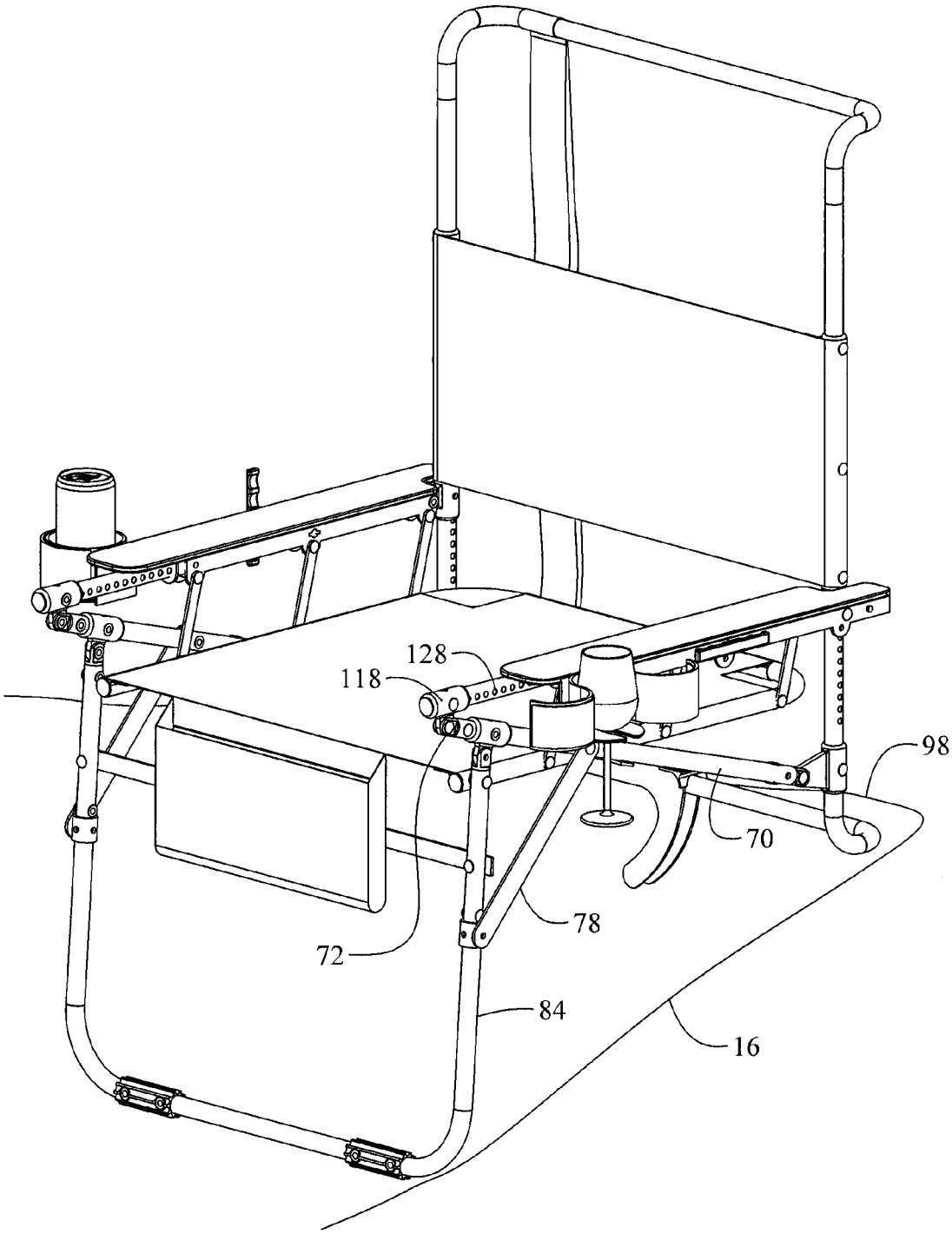
FIG. 29 is a front perspective view of the chair positioned on the angled surface.
Figure 30:
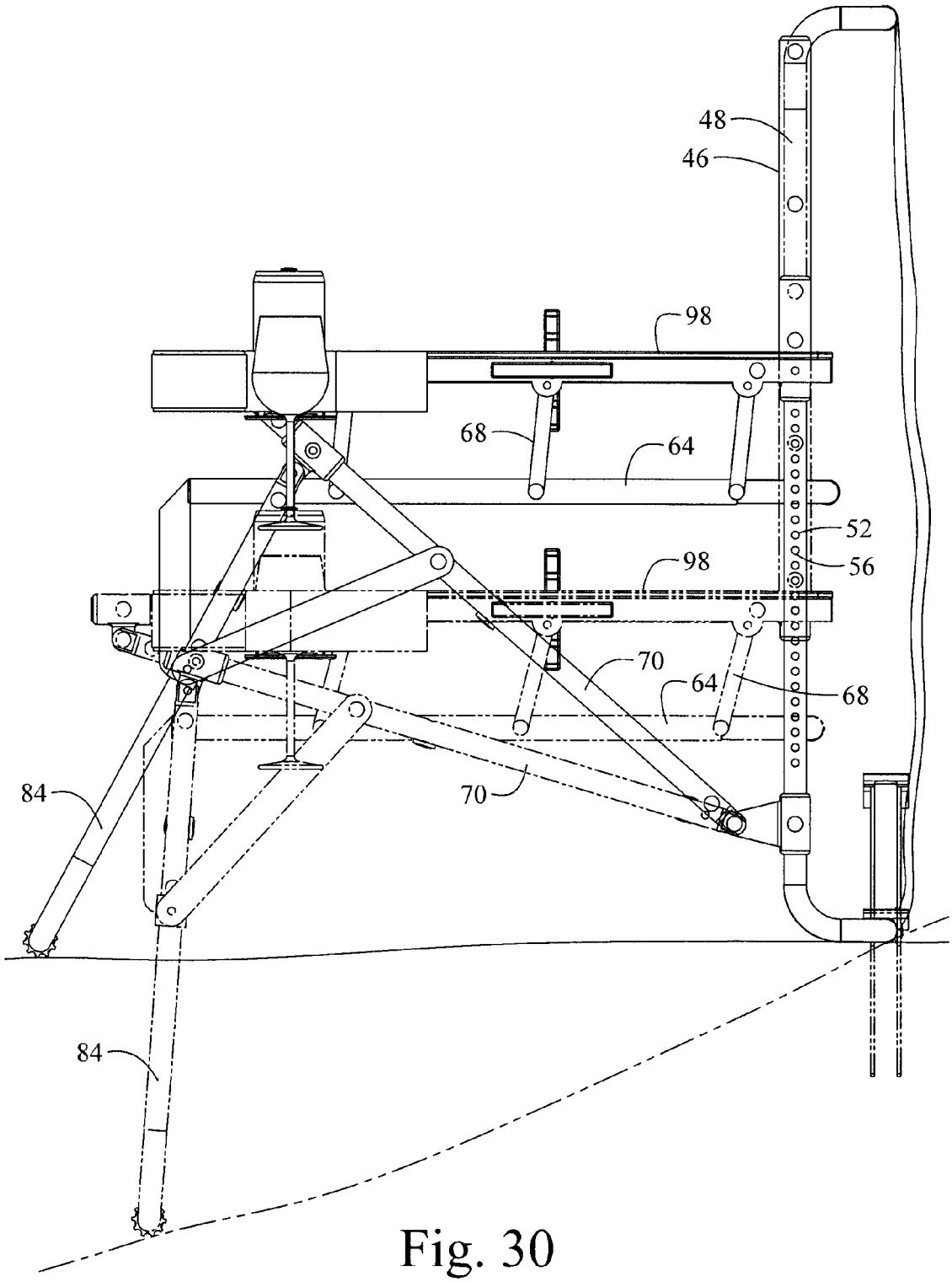
FIG. 30 is a side elevational view of the chair being positioned between the flat surface and the angled surface.

As shown in FIG. 7, the anchor 30 rotatably connects with lower back member 44. The anchor 30 is configured to rotate, when acted upon by a force, around the lower back member 44 and to penetrate the ground surface 16 (FIG. 24) to stabilize the chair A to the ground surface 16. The anchor 30 includes a pair of oppositely spaced engagement members 150 defining an aperture or open channel therethrough. Each member 150 has a straight portion 152 and a curved portion 154. The straight portion 152 rotatably connects with the lower back member 44 via a hinge connector. A flat cover 156 connects together the straight portions 152 wherein a foot pad 158 is positioned on the flat cover 156 near the intersection of the straight portion 152 and the curved portion 154. The cover 156 is positioned over the channel between the straight portions 152.

The channel between the curved portions 154 remains open. The hinged connection of the straight portions 152 to the lower back member 44 positions the open channel of the curved portions 154 around the lower back member 44. Ends of the curved portion 154 are configured to penetrate the ground surface. Ends may be rounded or pointed to penetrate the ground surface.

The foot stabilizer 160 includes a molded member that inserts around the bottom leg member 44. The foot stabilizer 160 includes ribs 162 extending outward from the leg member 44 wherein the ribs 162 adhere to the ground surface 16 to provide an anti-skid force against the ground surface 16.

As shown in FIG. 24-30 each of the second back ends 40, second support ends 66 and bottom leg member 44, via the foot stabilizer 160, contacts the surface 16. The support assembly 20 is rotatable around the support hinge 79 at a plurality of angles with respect to the angled surface 16. Furthermore, the leg assembly 22 is rotatable around the leg hinge 80 at a plurality of leg angles with respect to the angled surface 16. The arm assembly 28 is also rotatable around the support hinge 79 on the back assembly 18 at a plurality of angles with respect to the leg assembly 22, support assembly 20 and angled surface 16. Further, the upper back side members are movable downward to and over the lower back side members. Since the support assembly 20, leg assembly 22, arm assembly 28 are rotatable at the plurality of angles with respect to the angled surface 16 and the back assembly 18 is movable, the chair A may be rotatably positioned on the angled surface 16 in order to position the body 64 of the seat 24 in a substantially horizontal position with respect to the angled surface 16.

Turning to FIGS. 20-23 and referring to FIG. 1, the chair A is configured to fold between the collapsed position 14 and the expanded position 12. The leg assembly 22 rotates around the leg hinge 80 and folds toward the support assembly 20. Since the leg assembly 22 is rotatable around the leg hinge 80 at a plurality of angles, the lower leg ends rotate upward and toward the second support ends 74 in order to fold near the support side members 70.

Additionally, the support assembly 20 rotates toward the back assembly 18. Since the support assembly 20 rotates around the seat hinge 79 at the plurality of angles, the first support ends 72 rotate toward the first back ends 38 of the back frame 32. The arm assembly 28 disengages from the back assembly 18 while remaining rotatably connected to the support assembly 20. In particular, the user disengages the engagement pin 54 connecting the hanger track 100 of the arm assembly 28 to the hinge 50 of the upper back member 46. Upon disengaging the hanger track 100 from the hinge 50, the arm rest 98 and associated brackets 130 and tracks are free to rotate downward about the hinge connector with the first support end 72. Due to the rotatable connection, the arm assembly 28 rotates near the back assembly 18 to position the inner telescoping member 118 upward near the first back end 38. The support assembly 20 rotates to position the first support end 72 upward and near the first back end 38 and the second support end 74 near the second back end 40. As such, leg assembly 22, support assembly 20, arm assembly 28 and back assembly 18 are aligned to provide a convenient and collapsible carrying position for the user. Furthermore, the back side members 36 are sized to expose the carrier strip beyond the first back end 38 and the second back end 40 to provide a convenient access for the user to carry the chair A in the collapsed position 14.

Turning to FIGS. 24-30 and referring to FIGS. 1-23, during use, the person unfolds the chair A from the collapsed position 14 to the expanded position 12 and positions the chair A on the surface 16, which may be angled with respect to the horizon. The user conveniently carries the chair A via the carrier strap and places the chair on the angled surface 16 in the collapsed position 14. The user then unfolds the support assembly 20 from the back assembly 18 by moving the support assembly 20 along the seat hinge 54.

While rotating the support assembly 20, the user slides the outer telescoping member 46 upward and around the lower telescoping member 48 to position the back frame 32 at a desired height wherein the user can engage the outer telescoping member 40 to the inner telescoping member 48 via engagement pin.

The user then rotates the leg assembly 22 from the support assembly 20 by rotating the leg assembly 22 around the leg hinge 80. In rotating the leg hinge 80 in the plurality of angles, the user moves the bottom leg members 44 in contact with the angled surface 16. Then the user can move the arm assembly 28 upward to engage the back assembly 18. In particular, the user moves the hanger bracket 106 upward to engage the back side member 36 via the engagement pin. In moving the hanger track 106 upward, the armrest support 98 and associated brackets 130 rotate around the rotatable connection with the first support end 72 to become horizontal with respect to the ground surface 16. Due to rotation of the arm brackets 130, the seat 26 suspends from the arm assembly 28 via the hangers 68 rotatably connected to the hanger bracket 106 and to the seat frame 58.

During use, the inner telescoping member inserts 118 within the outer telescoping member 116 supported by the ribs 136 and brackets 130. The user rotates the handle 144 and associated key shaft 146 to move the linkage bar 138 and associate lock pins 142 away from and out of the spaced brackets 130 to allow the inner telescoping member 118 to reciprocally move within outer telescoping member 116. At a desired position of the position of the inner telescoping member 118 within the outer telescoping member 116, the user rotates the key shaft 146 and pushes the lock handle 144 to move the linkage bar 128 and associated pins 142 toward the brackets 130 to engage the lock pins 142 with the apertures 128 of the inner telescoping member 118 so as to lock the inner telescoping member 118 in the preferred position within the outer telescoping member 116. The springs 148 maintain a bias force on the engaged lock pins 142.

Depending upon the angle of the surface 16, the user can easily adjust the angle of leg assembly 22, support assembly 20 and back assembly 18 through the respective hinges and pins to accommodate the desired position of the leg assembly 22, support assembly 20 and back assembly 18. Further, as the user adjusts the chair to the angled surface 16, the rotatable hangers 68 rotate to position the seat 26 substantially horizontal in the extended position while the chair A is positioned on the angled surface 16.

During operation, the user places the lower back member 44 on the ground surface 16 and places their foot or hand on the foot pad 158 of the anchor 30. The user then applies downward pressure to the foot pad 158 to rotate the straight portions 152 and the curved portions 154 toward the ground surface 16. The open channel of the curved portions 154 moves around the enclosed lower back member 44. Upon movement of the straight portions 152 and curved portions 154, the ends of the curved portions 154 penetrate the ground surface 16 to anchor the chair to the ground 16.

On a substantially flat surface, the user positions the leg assembly 22, support assembly 20 and back assembly 18 on the ground surface 16 to provide the substantially horizontal position for the seat 26 via the rotatable hanger 68. As the surface angles, however, the user conveniently moves the legs 84 and support 70 to maintain the body 64 of the collapsible seat in the substantially horizontal position since the hangers 68 rotate freely while the legs 84 and supports 70 move in response to the angles surface.

The back assembly 18, support assembly 20, leg assembly 22, seat assembly 24 and the arm assembly 26 comprise a light weight material including, but not limited to, a metal alloy or plastic. Suitable metal alloys include but are not limited to aluminum, aluminum alloy, steel and steel alloy. The back assembly 18, support assembly 20, leg assembly 22, seat assembly 24 and the arm assembly 26 may comprise channel members or solid members. The components of the chair A, however, can form other configurations such as, for example, tubular sleeve having a square, rectangular, triangular, or other polygonal or curvilinear cross section.

As various changes could be made in the above constructions without departing from the scope of the disclosure, it is intended that all matter contained in the above description or shown in the accompanying drawings shall be interpreted as illustrative and not in a limiting sense.

The invention claimed is:

1. A foldable chair, said chair comprising:

a plurality of hinges structured and operable to collapsibly configure the chair between an expanded position and a collapsed position, such that the chair can seat a person substantially horizontal while the chair is positioned on an angled surface, the plurality of hinges including a plurality of seat hinges and a plurality of leg hinges;

a back assembly having a back frame and a back covering which at least partially covers the back frame, the back frame including opposing back side members, each back side member having a first back end and a second back end;

a support assembly pivotally coupled to the back frame via the seat hinges, the support assembly having opposing support side members, each support side member having a first support end and a second support end;

a leg assembly pivotally coupled to the support assembly via the leg hinges, the leg assembly having a leg frame which includes opposing leg side members;

a pair of opposing arm assemblies adjustably connected to the back frame and pivotally connected to a respective side member first support end, each arm assembly having an armrest positioned between the back frame and the side member first support end and having a hanger bracket extending downward form the armrest; and a seat assembly rotatably connected to the arm assembly, the seat assembly having a seat frame and a hanger connected to the seat frame, the hanger being configured to rotatably connect to the hanger bracket of the arm assembly such that the seat frame rotatably suspends from the arm assembly to position the seat frame in a substantially horizontal position with respect to the angled surface.

2. The foldable chair of claim 1 wherein the back frame includes an upper back member that is configured to connect the back side members between the first back ends and includes a lower back member that is configured to connect the back side members between the second back ends.

3. The foldable chair of claim 2 further comprising an anchor rotatably connected to the lower back member.

4. The foldable chair of claim 3 wherein the anchor comprises a straight portion and a curved portion such that the straight portion rotatably connects to the lower back member and the curved portion rotatably moves around the lower back member.

5. The foldable chair of claim 1 wherein each arm assembly comprises a pair spaced brackets connected to the armrest, the brackets are spaced to form a channel there between.

6. The foldable chair of claim 5 wherein each arm assembly comprises an outer telescoping member connected to a respective one of the back side member first back ends and an inner telescoping member connected to a respective one of the back side member second back ends, each outer telescoping member being configured to further connect to the respective armrest and within the respective channel and being configured to telescopingly accept the respective inner telescoping member such that a height of the back assembly can be adjusted to position the seat frame in the substantially horizontal position with respect to the angled surface.

7. The foldable chair of claim 6 wherein the inner telescoping member is configured to reciprocally move within the outer telescoping member.

8. The foldable chair of claim 7 wherein the inner telescoping member includes a plurality of apertures defined there through.

9. The foldable chair of claim 8 further comprising a lock assembly removably connected to the inner telescoping member.

10. The foldable chair of claim 9 wherein the lock assembly comprises a linkage bar and a pin connected to the linkage bar wherein the pin removably engages one of the apertures of the inner telescoping member.

11. The foldable chair of claim 1 wherein the support assembly is rotatable around the seat hinge at a plurality of angles with respect to the angled surface.

12. The foldable chair of claim 1 wherein the leg assembly is rotatable around the leg hinge at a plurality of angles with respect to the angled surface.

* * * * *